US009303600B2

(12) United States Patent
Kato

(10) Patent No.: US 9,303,600 B2
(45) Date of Patent: Apr. 5, 2016

(54) FUEL VAPOR LEAKAGE DETECTION METHOD

(71) Applicant: DENSO CORPORATION, Kariya, Aichi-pref. (JP)

(72) Inventor: Yasuo Kato, Niwa-gun (JP)

(73) Assignee: DENSO CORPORATION, Kariya (JP)

( * ) Notice: Subject to any disclaimer, the term of this patent is extended or adjusted under 35 U.S.C. 154(b) by 243 days.

(21) Appl. No.: 14/050,411

(22) Filed: Oct. 10, 2013

(65) Prior Publication Data

US 2014/0102421 A1 Apr. 17, 2014

(30) Foreign Application Priority Data

Oct. 11, 2012 (JP) ..... 2012-225907

(51) Int. Cl.
*F02M 25/08* (2006.01)

(52) U.S. Cl.
CPC ..... *F02M 25/0854* (2013.01); *F02M 25/0818* (2013.01)

(58) Field of Classification Search
CPC .... F02D 41/0032; F02D 41/22; F02M 25/08; F02M 25/0809; F02M 25/0854; F02M 33/02
USPC ..... 123/516–521; 73/114.39
See application file for complete search history.

(56) References Cited

U.S. PATENT DOCUMENTS

2003/0226549 A1* 12/2003 Takagi et al. ..... 123/520
2004/0200460 A1* 10/2004 Mitani et al. ..... 123/520
2006/0144370 A1* 7/2006 Iihoshi et al. ..... 123/491
2006/0225714 A1* 10/2006 Kano et al. ..... 123/520
2007/0157908 A1 7/2007 Kano et al.
2007/0189907 A1* 8/2007 Kunihiro et al. ..... 417/44.2
2009/0277427 A1* 11/2009 Yoshimura ..... 123/520

(Continued)

FOREIGN PATENT DOCUMENTS

JP 2002-202008 7/2002
JP 2004-251251 9/2004

(Continued)

OTHER PUBLICATIONS

Office Action (2 pages) dated Sep. 30, 2014, issued in corresponding Japanese Application No. 2012-225907 and English translation (2 pages).

(Continued)

*Primary Examiner* — John Kwon
*Assistant Examiner* — Johnny H Hoang
(74) *Attorney, Agent, or Firm* — Nixon & Vanderhye P.C.

(57) ABSTRACT

A fuel vapor leakage detection device performs a fuel vapor leakage detection method to detect a clogging of passages in an evaporated fuel processing system by (i) switching a switching valve after measuring a first reference pressure, (ii) determining whether a detected pressure equals atmospheric pressure after opening a purge valve, (iii) recording the detected pressure after closing the purge valve, and (iv) switching the switching valve to depressurize an atmospheric system and to determine whether a current detection value of the pressure sensor is the same as the first reference pressure. Then, a second reference pressure is measured for comparison with the first reference pressure, to determine whether the evaporation system is clogged. In such manner, leakage and the clogging of the passages in an evaporated fuel processing system may be detected.

7 Claims, 17 Drawing Sheets

(56) References Cited

U.S. PATENT DOCUMENTS

| | | | | |
|---|---|---|---|---|
| 2011/0197862 | A1* | 8/2011 | Der Manuelian et al. | 123/521 |
| 2012/0047999 | A1* | 3/2012 | Itoh et al. | 73/40 |
| 2012/0130596 | A1* | 5/2012 | Ooiwa | 701/45 |
| 2014/0060498 | A1* | 3/2014 | Hasegawa et al. | 123/520 |

FOREIGN PATENT DOCUMENTS

| | | |
|---|---|---|
| JP | 2005-291122 | 10/2005 |
| JP | 2007-239569 | 9/2007 |

OTHER PUBLICATIONS

U.S. Appl. No. 13/962,223, Taniguchi, filed Aug. 8, 2013.

* cited by examiner

FUEL VAPOR LEAKAGE DETECTION METHOD

CROSS-REFERENCE TO RELATED APPLICATION

This application is based on and claims the benefit of priority of Japanese Patent Application No. 2012-225907 filed on Oct. 11, 2012, the disclosure of which is incorporated herein by reference.

TECHNICAL FIELD

The present disclosure generally relates to a fuel vapor leakage detection method for detecting fuel vapor leakage from a fuel tank.

BACKGROUND

Conventionally, an evaporated fuel process system collects fuel vapor in a fuel tank and supplies the collected fuel vapor to an air intake system of an internal combustion engine. The evaporated fuel process system is equipped with a fuel vapor leakage detection device for detecting fuel vapor leakage of a fuel tank and a canister while the internal combustion engine is stopped. The fuel vapor leakage detection device includes, together with other components, a pump that pressurizes/depressurizes an inside of a fuel tank and a canister, a purge pipe that sends a fuel vapor that is adsorbed by the canister to the air intake system of the engine, and a purge valve that is disposed on the purge pipe for establishing a communication between an inside of the purge pipe to the air intake system, or for interrupting such communication therebetween. The disclosure of a patent document 1 (i.e., Japanese Patent Laid-Open No. 2002-202008) is in regards to a fuel vapor leakage detection device that compares a first electric current value and a second electric current value. The first electric current value is supplied to the pump for pressurizing an inside of the purge pipe when the purge valve is in a closed state. The second electric current value is supplied to the pump when the inside of the pressurized purge pipe is temporarily in communication with the air intake system, in order to detect a leakage and/or clogging of the purge pipe.

However, the fuel vapor leakage detection device in the patent document 1 cannot detect a clogging of an air passage that introduces air (i.e., atmosphere) into the canister. Therefore, when the air passage is clogged, fuel vapor that is adsorbed by the canister cannot be supplied to the air intake system.

SUMMARY

It is an object of the present disclosure to provide a fuel vapor leakage detection method that is capable of appropriately detecting a clogging of a passage in an evaporated fuel process system.

In an aspect of the present disclosure, the fuel vapor leakage detection method of a fuel vapor leakage detection device includes a canister connection passage connected to a canister that absorbs a fuel vapor in a fuel tank, an air passage for allowing fluid communication between the canister connection passage and atmosphere, a pressure detection passage for allowing fluid communication with the canister connection passage, a switching valve selectively switching fluid communication of the canister connection passage with one of the pressure detection passage or the air passage, a bypass passage for bypassing the switching valve that provides fluid communication between the canister connection passage and a pressure detection passage), and a pressure-depressure unit (i) pressurizing or depressurizing the fuel tank and the canister when the switching valve establishes fluid communication between the canister connection passage and the pressure detection passage and (ii) pressurizing or depressurizing the air passage when the switching valve establishes fluid communication between the canister connection passage and the air passage. The fuel vapor leakage detection device also includes a throttle positioned within the bypass passage, a pressure detector detecting a pressure of the pressure detection passage and outputting a signal according to a detected pressure of the pressure detection passage, a purge valve fluidly connected to a purge passage, the purge valve opening and closing fluid communication between an intake air passage of an internal combustion engine and the canister, a valve controller for controlling the switching valve and the purge valve, a purge determination unit for determining whether a pressure within the purge passage is equal to an atmospheric pressure, and a determination unit for determining whether a pressure of the air passage is equal to a predetermined pressure. The fuel vapor leakage detection method opens the purge valve when (i) the switching valve establishes fluid communication between the canister connection passage and the pressure detection passage and (ii) the pressure-depressure unit pressurizes or depressurizes the fuel tank and the canister, detecting a pressure of the purge passage with the pressure detector when the purge passage is in fluid communication with the pressure detection passage via the canister after opening the purge valve, determines the pressure with the purge determination unit based on the pressure of the purge passage detected by detecting a pressure of the purge passage. The fuel vapor leakage detection method also switches the switching valve to establish fluid communication between the canister connection passage and the air passage when (i) the switching valve is switched to establish fluid communication between the canister connection passage and the pressure detection passage and (ii) the pressure-depressure unit is pressurizing or de-pressurizing the fuel tank and the canister. Further, the fuel vapor leakage detection method detects the pressure with the pressure detector of the air passage in fluid communication with the pressure detection passage via the switching valve after switching the switching valve, and determines the pressure with the determination unit based on the pressure of the air passage detected by detecting the pressure with the pressure detector of the air passage.

In the fuel vapor leakage detection method of the present disclosure, the fuel vapor leakage detection device detects, while performing a leak check for the fuel tank, the canister, the purge passage and the canister connection passage, a clogging of (i) the purge passage that establishes communication between the canister and (ii) the air intake system and a clogging of the air passage that establishes communication between the switching valve and the atmosphere, by utilizing a negative pressure of the canister and the canister passage that are caused by depressurization at a time of the leak check. When either the purge passage or the air passage that should be in communication with the atmosphere is clogged, the negative pressure caused by the leak check will not return to atmospheric pressure or to a certain predetermined pressure. Therefore, the clogging of the purge/air passage is detected. In such manner, the performing of a single leak check may simultaneously detect a clogging of two passages (i.e., the purge/air passage), thereby enabling a sufficient number of clogging detections for those passages.

Further, since a single leak check may simultaneously detect the clogging of two passages (i.e., the purge/air passage), a wait time while waiting for a stabilized operation of the pressure detector and an operation time of the pressure-depressure unit (i.e., a pump) may be reduced, which would otherwise be required to detect the clogging of each of the two passages. That is, in other words, power consumption caused by the operation of the pressure detector and the pressure-depressure unit for the detection of each passage may be reduced.

BRIEF DESCRIPTION OF THE DRAWINGS

Other objects, features and advantages of the present disclosure will become more apparent from the following detailed description with reference to the accompanying drawings, in which.

DETAILED DESCRIPTION

Plural embodiments of the present disclosure are described in the following with reference to the drawings.

(First Embodiment)

Figure 1:
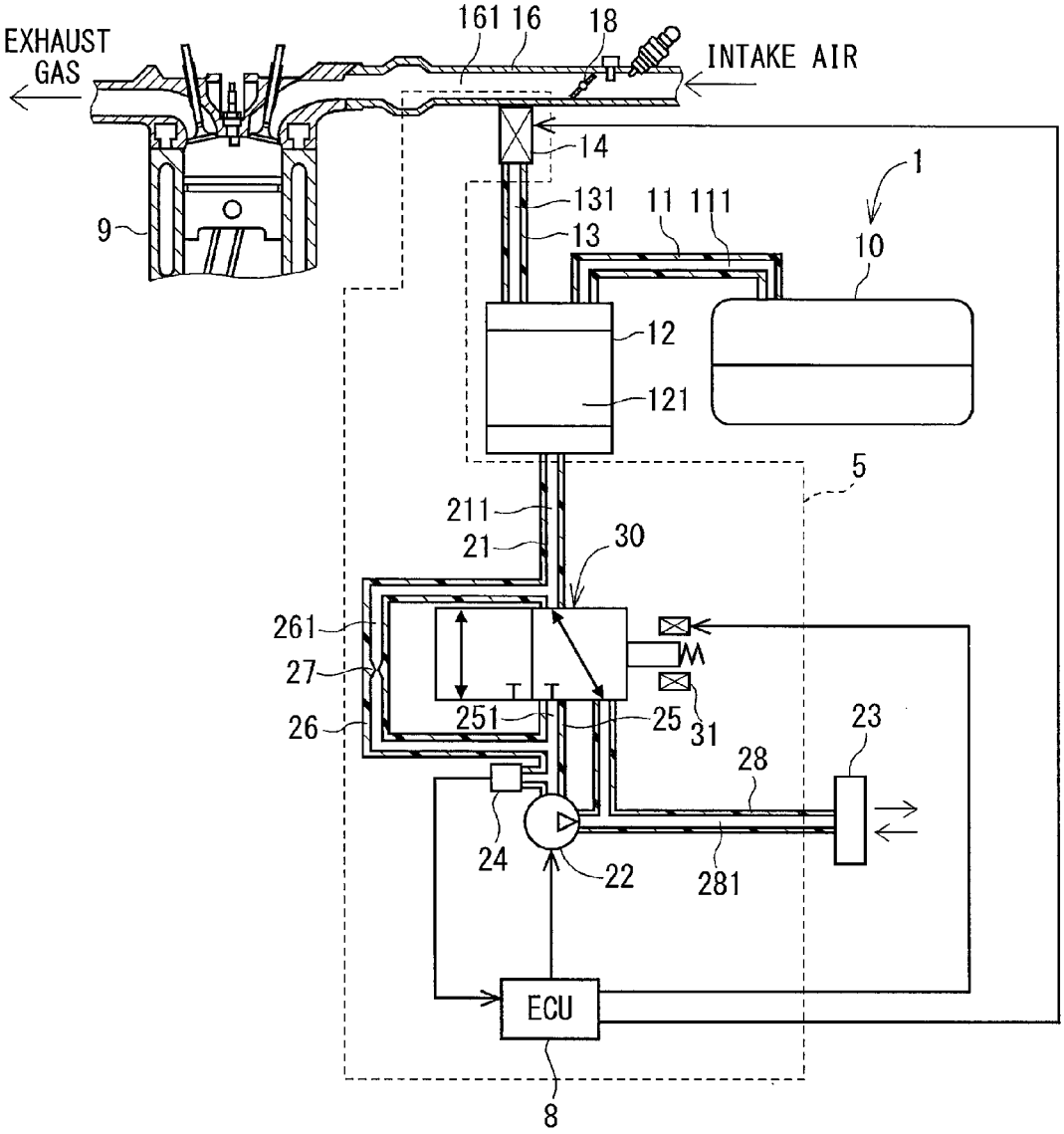
FIG. 1 is a diagram of an evaporated fuel process system having a fuel vapor leakage detection device that is used for a fuel vapor leakage detection method in a first embodiment of the present disclosure.

In FIG. 1, an evaporated fuel process system having a fuel vapor leakage detection device that is used for a fuel vapor leakage detection method in the first embodiment of the present disclosure is illustrated.

The evaporated fuel process system 1 includes a fuel tank 10, a canister 12, a fuel vapor leakage detection device 5, an air filter 23, an ECU 8 and the like. In the evaporated fuel process system 1, the canister 12 collects an evaporated fuel in the fuel tank 10. The canister 12 purges the collected fuel vapor to an intake air passage 161 that is formed by an intake air pipe 16, which is an "air intake system", connected to an engine 9 that is an "internal combustion engine."

The fuel tank 10 stores a volume of fuel that is supplied for the engine 9. The fuel tank 10 is connected to the canister 12 through the communication pipe 11. The communication pipe 11 forms a communication passage 111 that allows communication between the fuel tank 10 and the canister 12.

The canister 12 is equipped with a canister adsorbent 121 for collecting the evaporated fuel in the fuel tank 10.

The canister 12 is connected to the intake air pipe 16 through a purge pipe 13 that serves as a "purge passage formation member/material" for forming a purge passage 131.

A fuel vapor leakage detection device 5 includes a canister connection pipe 21, a pump 22, a pressure sensor 24, a pressure detection pipe 25, an air passage pipe 28, a switching valve 30, a switching valve bypass pipe 26, a standard orifice 27 and a purge valve 14, together with other parts.

The fuel vapor leakage detection device 5 detects a fuel vapor leakage from the fuel tank 10 and from the canister 12 by depressurizing an inside of the fuel tank 10 and an inside of the canister 12 by using the pump 22 that serves as a "pressure-depressure unit", and detects a clogging of the purge pipe 13 and the air passage pipe 28.

The canister connection pipe 21 forms (i.e., serves as) a canister connection passage 211 that allows communication between the switching valve 30 and the canister 12. The canister connection pipe 21 that may be designated as a "canister connection passage formation member" is connected to the switching valve bypass pipe 26 that serves as a "bypass passage formation member" that forms (i.e., servers as) a switching valve bypass passage 261 that allows communication between the canister connection passage 211 and a pressure detection passage 251 without passing through the switching valve 30.

The pump 22 is connected to two pipes, that is, to the pressure detection pipe 25 forming (i.e., serving as) a pressure detection passage 251 and to the air passage pipe 28 forming an air passage 281. The pump 22 is electrically connected to the ECU 8, and sucks a gas in an inside of the fuel tank 10, the communication passage 111, the canister 12, the purge passage 131, and the canister connection passage 211, or sucks a gas in an inside of the air passage 281 through the switching valve bypass passage 261, the canister connection passage 211 and the switching valve 30.

The pressure detection pipe 25 is connected to the switching valve 30, the switching valve bypass pipe 26, and the pump 22. On the pressure detection pipe 25 that serves as a "pressure detection passage formation member" for forming the pressure detection passage 251, the pressure sensor 24 that serves as a "pressure detector" to detect a pressure of the pressure detection passage 251 is disposed.

The air passage pipe 28 is connected to the switching valve 30, the air filter 23, and the pump 22. The air passage pipe 28 that serves as an "air passage formation member" for forming the air passage 281 allows a gas in the fuel tank 10 or in the canister 12 to flow therethrough toward the air filter 23. The air passage pipe 28 also allows passing of an air that is introduced into the canister 12 when the fuel vapor collected in the canister 12 is purged to the intake air pipe 16.

The switching valve 30 is a so-called electromagnetic operation valve. The switching valve 30 is electrically connected to the ECU 8, and switches communication of the canister connection passage 211 either to the pressure detection passage 251 or to the air passage 281 according to an electric power that is output from the ECU 8 to a coil 31.

The standard orifice 27 that serves as a "throttle" is disposed on the switching valve bypass pipe 26. The size of the standard orifice 27 corresponds to the size of a hole that defines an upper limit value of the tolerance of a leak air that contains the evaporated fuel from the fuel tank 10.

The purge valve 14 is an electromagnetic valve, and is disposed on the purge pipe 13. An amount of purging of the evaporated fuel from the canister 12 toward a downstream side of a throttle valve 18 of the intake air passage 161 is controlled by adjusting an opening degree of the purge valve 14.

The air filter 23 is connected to one end, that is, an atmosphere side end, of the air passage pipe 28. The air filter 23 collects foreign matter included in the air (i.e., atmosphere) that is introduced into the evaporated fuel process system 1. An arrow in FIG. 1 indicates a flow direction of the introduced intake air (i.e., atmosphere or air at atmospheric pressure).

The ECU 8 includes, together with other parts, a microcomputer having a CPU that serves as an arithmetic unit and a RAM, a ROM and the like that respectively serve as a memory. The ECU 8 is electrically connected to the pressure sensor 24, the pump 22 and the coil 31. The ECU 8 receives a signal that represents a pressure of the pressure detection passage 251 which is detected by the pressure sensor 24, and records such signal. Further, the ECU 8 outputs a signal that controls an operation of the pump 22. Further, the ECU 8 controls an electric power that is output to the coil 31. The ECU 8 is thus equivalent to a "valve controller", a "purge determination unit" and a "determination unit" in the claims.

A leak check procedure which is performed by the fuel vapor leakage detection device 5 as a fuel vapor leakage detection method in the first embodiment of the present disclosure is described with reference to FIG. 2 and FIG. 3.

Figure 2:
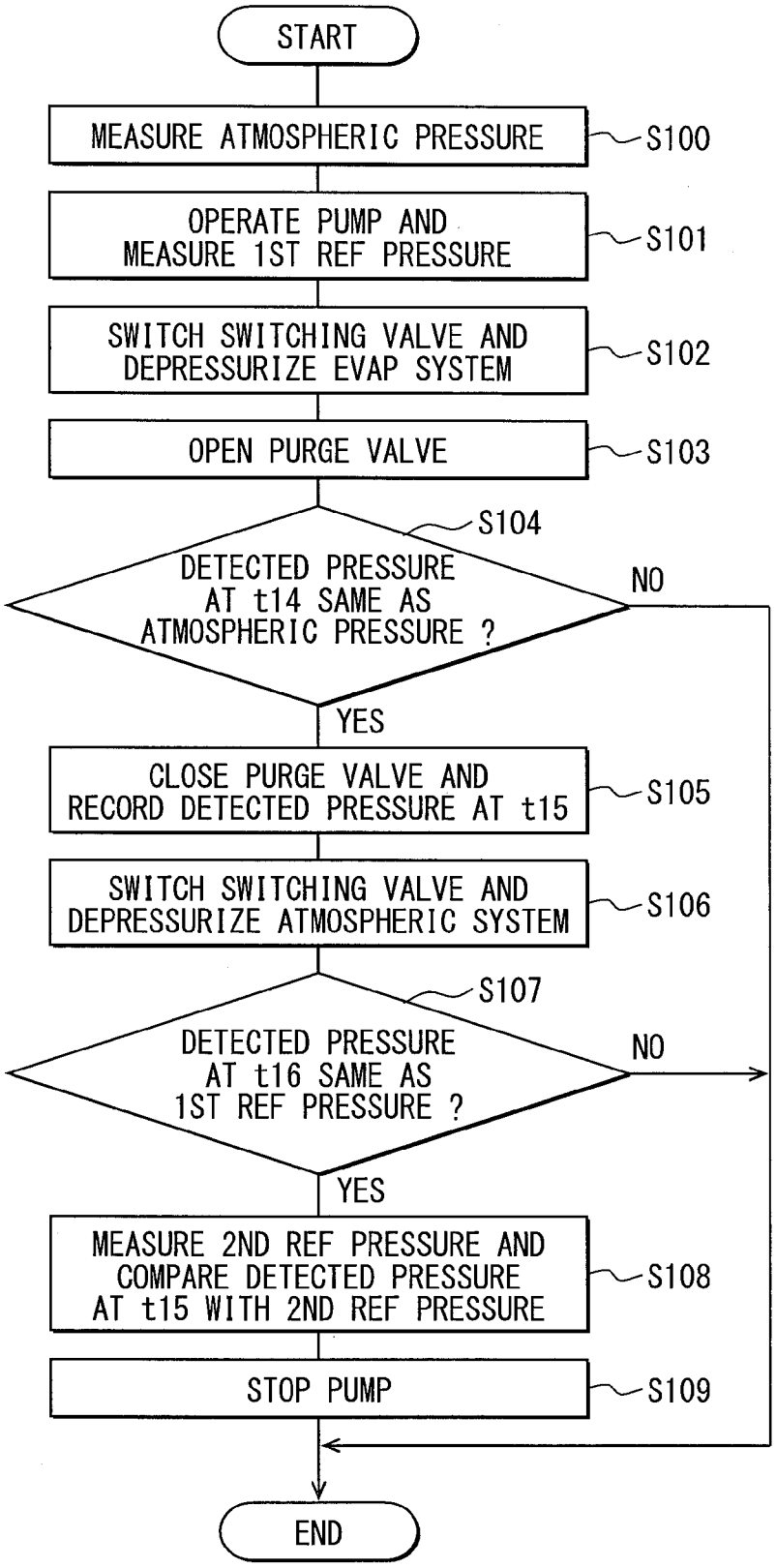
FIG. 2 is a flowchart of the fuel vapor leakage detection method in the first embodiment of the present disclosure.

FIG. 2 is a flowchart of a fuel vapor leakage detection method in the first embodiment, which realizes a leak check process. FIG. 3 is an operation diagram of various parts in the leak check process of the first embodiment, including an operation state of the pump 22, a switching state of the switching valve 30, an opening and closing state of the purge valve 14 and time change of a detection value of the pressure sensor 24.

Figure 3:
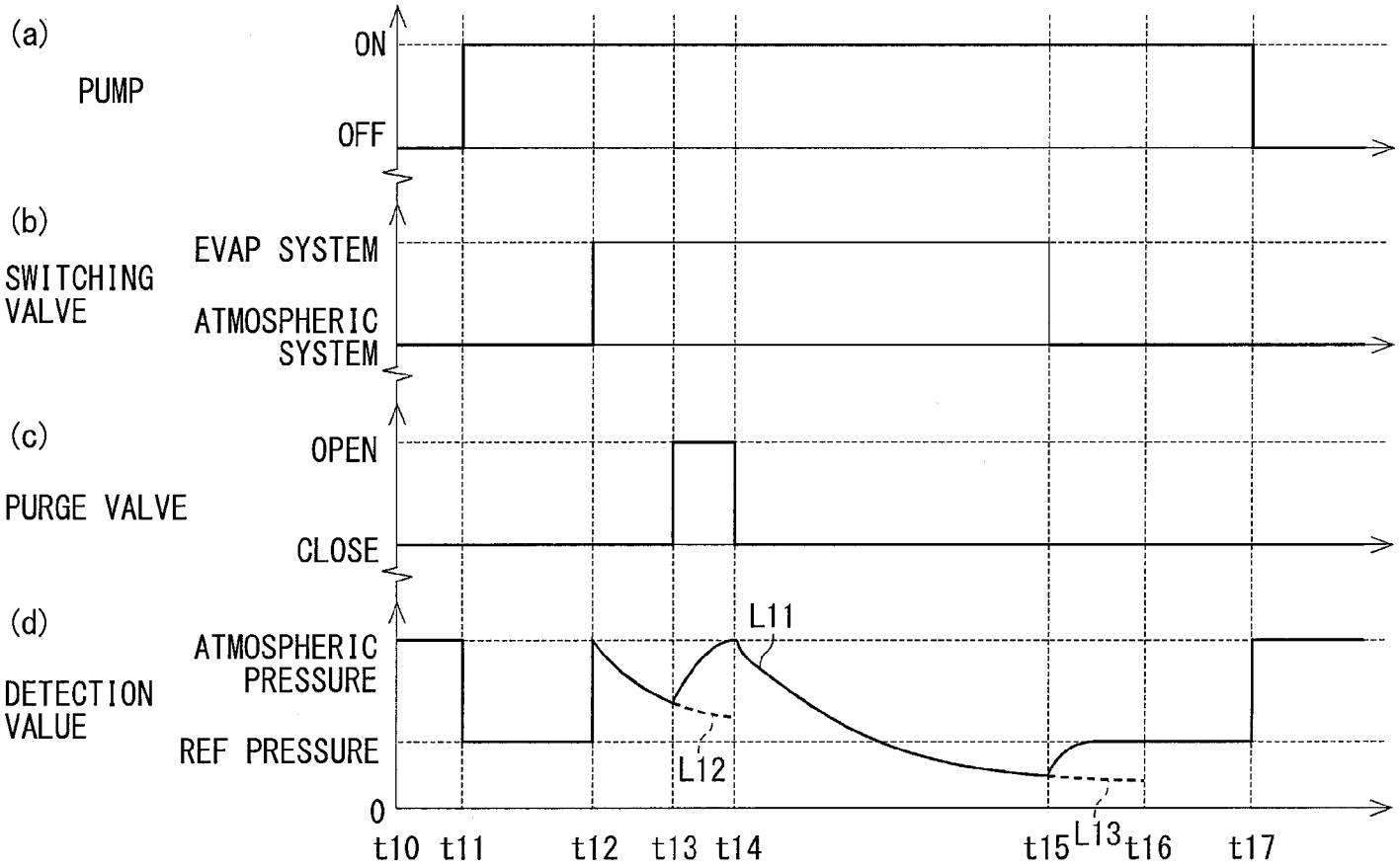
FIG. 3 is a time chart illustrating an operation of a pump, a switching valve and a purge valve together with a detection value of a pressure sensor in the fuel vapor leakage detection method in the first embodiment of the present disclosure.

The leak check process of the first embodiment is started at a predetermined time after a stop of the operation of the engine 9 by the EUC 8, the operation of which is triggered by a soak timer (i.e., at time t10 of FIG. 3). At such moment, the pump 22 in the fuel vapor leakage detection device 5 is in a stop state as shown in FIG. 3 at time t10, and the switching valve 30 is switched to allow communication between the canister connection passage 211 and the air passage 281 therethrough, and the purge valve 14 is in a valve closed state. A state of the fuel vapor leakage detection device 5 when it starts a leak check is designated as an "initial state."

In step S100 (i.e., a word "step" may be omitted hereafter), an error correction for correcting an error in the atmospheric pressure due to a parking altitude of a vehicle is performed by measuring an atmospheric pressure by pressure sensor 24. In the initial state described above, the pressure detection passage 251 is in communication with the atmosphere (i.e., an ambient air) through the switching valve bypass passage 261, the canister connection passage 211, the switching valve 30, the air passage 281 (i.e., these five parts 251, 261, 211, 30, 281 are collectively designated as an "atmospheric system" hereinafter), and the air filter 23, and the operation of the pump 22 is being stopped. In such manner, the pressure of pressure detection passage 251 becomes equal to the atmospheric pressure. The fuel vapor leakage detection device 5 records the detection value of the pressure sensor 24 in the ECU 8 during a period between time t10 and time t11 in FIG. 3, and the detection value recorded in the ECU 8 is thereafter used as the atmospheric pressure. When the pressure sensor 24 detects an atmospheric pressure, the ECU 8 calculates an altitude of a place where the vehicle is parked based on the detected pressure.

In S101, by operating the pump 22, a first reference pressure is measured. The ECU 8 outputs a signal for operating the pump 22 at time t11, and the operation of the pump 22 is started. The pump 22 sucks atmospheric air through the air filter 23 and the atmospheric system. The passage through which the atmosphere is sucked is narrowed by the standard orifice 27, and the pressure of the pressure detection passage 251 becomes a pressure that is defined by the size of the hole of the standard orifice 27. In the fuel vapor leakage detection device 5, the detection value of the pressure sensor 24 during a period between time t11 and time t12 of FIG. 3 is recorded in the ECU 8 as the first reference pressure. The first reference pressure is equivalent to a "predetermined pressure" in the claims.

In S102, by switching the switching valve 30, the purge passage 131 and other parts are depressurized. After time t12, the switching valve 30 is switched so that the following parts collectively designated as an "evaporation system" are in communication with each other without passing through the switching valve bypass passage 261. That is, the evaporation system including the pump 22, the pressure detection passage 251, the canister connection passage 211, the fuel tank 10, the canister 12, the communication passage 111, and the purge passage 131 may be in fluid communication by the switching of the switching valve 30. At such moment, the pressure of the evaporation system becomes lower than the atmospheric pressure, but is not depressurized to the first reference pressure detected in S101 (time t13 of FIG. 3).

In S103, the purge valve 14 is opened. By opening the purge valve 14, the atmosphere is introduced into the evaporation system through the intake air passage 161, because of the pressure of the evaporation system being depressurized to a level that is equal to or lower than the atmospheric pressure at time t13, which is not to (i.e., above) a level of the first reference pressure.

In S104, it is determined whether the detection value of the pressure sensor 24 is the same as the atmospheric pressure. The opening of the purge valve 14 at time t13 has introduced the atmosphere to flow into the evaporation system. When the purge passage 131 is not clogged, the atmosphere flowing in from the intake air passage 161 reaches the pressure detection passage 251, thereby making the detection value of the pressure sensor 24 at time t14 substantially equal to the atmospheric pressure as shown by a solid line L11 in FIG. 3. On the other hand, when the purge passage 131 is clogged, the atmosphere flowing in from the intake air passage 161 cannot reach the pressure detection passage 251, thereby making the detection value of the pressure sensor 24 at time t14 equal to a dotted line L12 in FIG. 3, which is lower than the atmospheric pressure.

The detection value of the pressure sensor 24 at time t14 is recorded in the ECU 8, and the process proceeds to step S105 based on a determination that no clogging is observed/detected in the purge passage 131 when the detection value of the pressure sensor 24 at time t14 is substantially the same value as the atmospheric pressure. Further, it is determined that a clogging is observed/detected in the purge passage 131 and finishes a leak check when the detection value of the pressure sensor 24 at time t14 is lower than the atmospheric pressure.

In S105, by closing the purge valve 14, the evaporation system is depressurized. That is, after time t14 in FIG. 3, by closing the purge valve 14, communication between the purge passage 131 and the intake air passage 161 is closed (i.e., dis-communicated or not in fluid communication). In such manner, the evaporation system is depressurized again. In step S105, the pressure is decreased to a level that is lower than the first reference pressure, and the detection value of the pressure sensor 24 is recorded in the ECU 8 at time t15.

In S106, by switching the switching valve 30, the atmospheric system is depressurized. More practically, after time t15 in FIG. 3, communication between the canister connection passage 211 and the air passage 281 is established by switching the switching valve 30. In such manner, the pressure detection passage 251 communicates with the atmosphere through the atmospheric system. The pump 22 sucks atmospheric air through the air filter 23 and the atmospheric system.

In S107, it is determined whether the detection value of the pressure sensor 24 is the same as the first reference pressure. That is, at time t15, by switching the switching valve 30, the air passage 281 is depressurized through the pressure detection passage 251, the switching valve bypass passage 261, and the switching valve 30. When the air passage 281 is not clogged, the detection value of the pressure sensor 24 at time t16 becomes substantially the same value as the first reference pressure as shown in FIG. 3 by the solid line L11, because the atmospheric air flows into the pressure detection passage 251 through the standard orifice 27. On the other hand, when the air passage 281 is clogged, the detection value of the pressure sensor 24 at time t16 decreases to be lower than the first reference pressure as shown in FIG. 3 by a dotted line L13, because the atmospheric air cannot flow into (i.e., cannot reach) the pressure detection passage 251 which preserves an influence of the depressurizing in S106.

The detection value of the pressure sensor 24 at time t16 is recorded in the ECU 8, and, when the detection value of the pressure sensor 24 at time t16 is substantially the same value as the first reference pressure, the process proceeds to S108 based on a determination that there is no clogging in the air passage 281. When the detection value of the pressure sensor 24 at time t16 is lower than the first reference pressure, the process of a leak check is finished with a determination that there is a clogging in the air passage 281.

In S108, a second reference pressure is measured. Similar to step S106, the pump 22 sucks atmospheric air through the air filter 23 and the atmospheric system in this step. Then, the detection value of the pressure sensor 24 during a period between time t16 and time t17 in FIG. 3 is recorded in the ECU 8 as the second reference pressure.

Further, in S108, a comparison between (i) the detection value of the pressure sensor 24 at time t15 which is detected in S105 and recorded in the ECU 8 and (ii) the second reference pressure detected in S108 is performed. When the detection value of the pressure sensor 24 at time t15 is lower than the second reference pressure, it may have been caused either by (a) no introduction of the atmospheric air from an outside into an inside of the fuel tank 10 or (b) a decrease of an air flow amount which is decreased to be lower than an expected flow amount of the standard orifice 27. Therefore, it is determined that the airtightness of the fuel tank 10 is sufficiently secured (i.e., no air leakage). On the other hand, when the detection value of the pressure sensor 24 at time t15 is higher than the second reference pressure, it may have been caused by an amount of an air flow through the standard orifice 27 which exceeds the expected air flow amount of the standard orifice 27. In other words, it is determined that the airtightness of the fuel tank 10 is not sufficiently secured (i.e., air leakage).

In S109, the operation of the pump 22 is stopped. The ECU 8 stops the operation of the pressure sensor 24 after detecting that the pressure of the pressure detection passage 251 has returned to the atmospheric pressure. In such manner, the fuel vapor leakage detection device 5 returns to the initial state, and finishes a leak check.

Conventionally, for detecting the clogging of the purge passage and the air passage by foreign matter, the pressure of the purge passage is detected by utilizing the negative pressure of an operating engine during an operation time of the engine, or the pressure of the purge passage is detected during an engine stop time, simultaneously with the leak check of the purge passage. However, the clogging detection of the purge passage during an engine operation time by such conventional method may not properly work when, for example, the vehicle is a plug-in hybrid vehicle which may operate the engine at fewer times than the non-hybrid vehicle, or when the vehicle yields only a "low" negative pressure from the engine, which cannot sufficiently depressurize the purge passage. Further, clogging detection during an engine stop time may only be capable of detecting only one of purge passage clogging and air passage clogging at each leak check, which may not be a sufficient number of detections because only one of two passages is examined for a clogging detection at each leak check.

The fuel vapor leakage detection method in the first embodiment performs, during a conventional leak check that is conventionally performed as an "after engine stop" check, (i) an evaporation system leak check and also performs (ii) a clogging check of the purge passage 131 and the air passage 281 by utilizing a negative pressure of the evaporation system or the atmospheric system. In such manner, in the fuel vapor leakage detection method by the first embodiment, a sufficient number of detections are performed since the clogging of the purge passage 131 and the clogging of the air passage 281 are detected at each leak check. That is, detection of (i) a clogging of the purge passage 131 and (ii) a clogging of the air passage 281 during an engine operation time is made unnecessary, thereby enabling an application of the fuel vapor leakage detection method in the first embodiment to a plug-in hybrid vehicle and to a low-negative-pressure engine vehicle.

Further, a wait time while waiting for a stabilized operation of the pressure sensor and an operation time of the pump for the detection of a clogging of the purge passage 131 and a clogging of the air passage 281 at each leak check, which are conventionally required for each of those two passages, can be reduced in half. Therefore, power consumption by the pressure sensor and the pump is reduced.

(Second Embodiment)

The fuel vapor leakage detection method in the second embodiment of the present disclosure is described with reference to FIGS. 4 and 5. The leak check procedure in the second embodiment is different from the procedure in the first embodiment. Further, like parts have like numbers in the first and second embodiments, for the brevity of the description.

Figure 4:
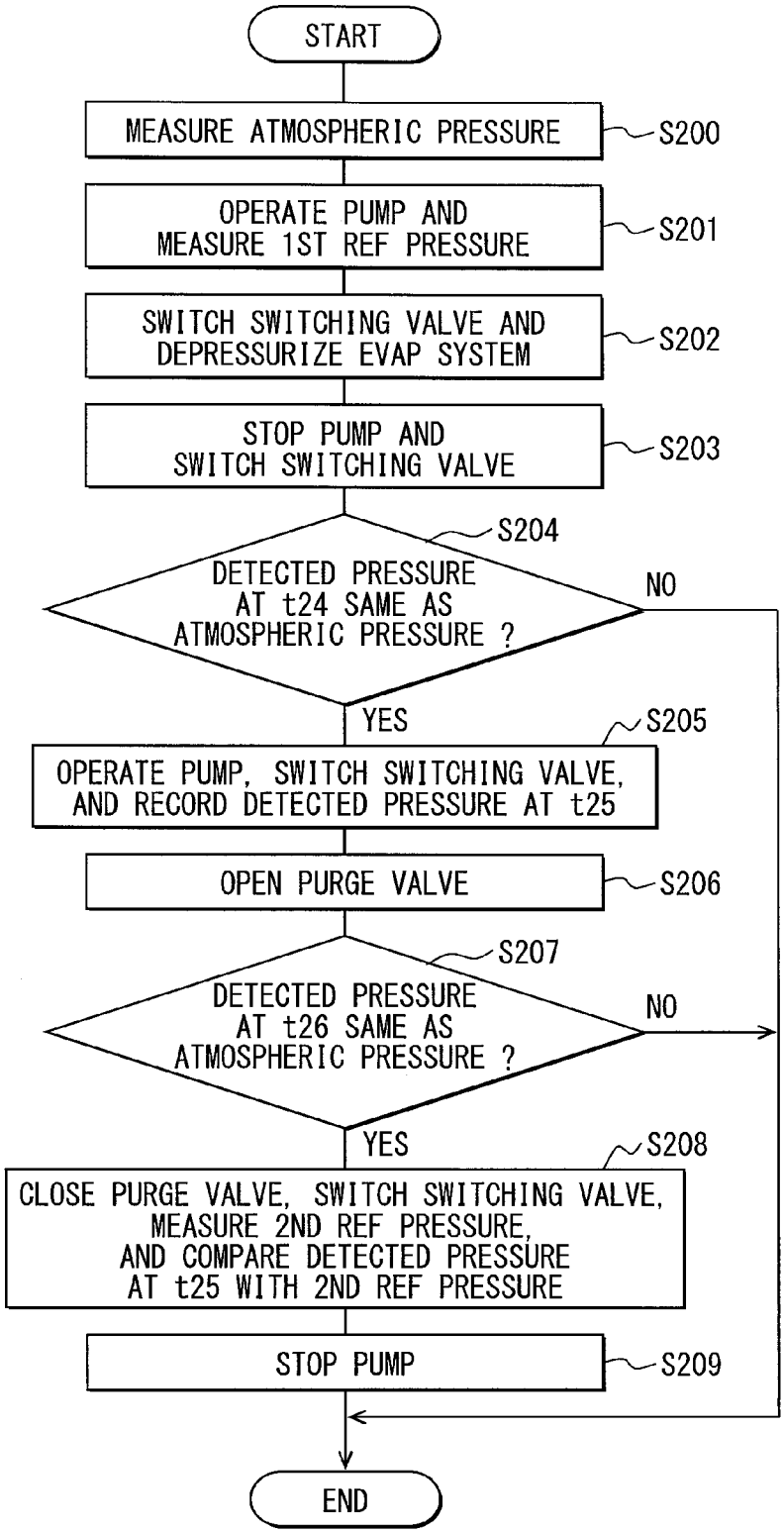
FIG. 4 is a flowchart of the fuel vapor leakage detection method in a second embodiment of the present disclosure.
Figure 5:
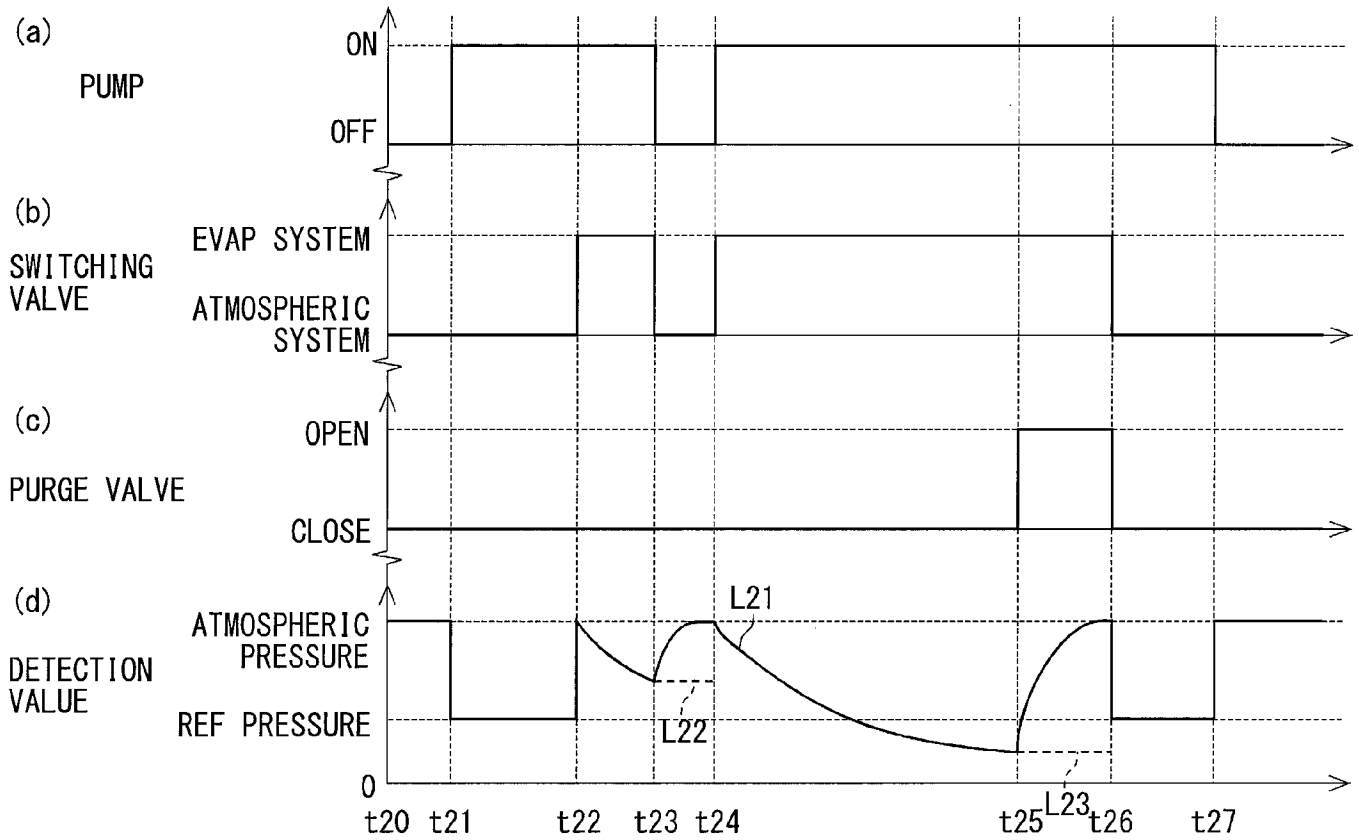
FIG. 5 is a time chart illustrating the operation of the pump, the switching valve and the purge valve together with the detection value of the pressure sensor in the fuel vapor leakage detection method in the second embodiment of the present disclosure.

FIG. 4 is a flowchart of the fuel vapor leakage detection method in the second embodiment of the present disclosure, which realizes a leak check process. FIG. 5 is an operation diagram of various parts in the leak check process, including an operation state of the pump 22, a switching state of the switching valve 30, an opening and closing state of the purge valve 14, and time change of a detection value of the pressure sensor 24.

The leak check process of the second embodiment is performed similarly to the process of the leak check from step S100 to step S102 in the first embodiment. More practically, the process in S200 measures the atmospheric pressure during a period between time t20 and time t21 in FIG. 5. Then, in S201, the process measures the first reference pressure during a period between time t21 and time t22 in FIG. 5. Then, in S202, the process switches the switching valve 30, and depressurizes the evaporation system during a period between time t22 and time t23 in FIG. 5.

Then, in S203, the process stops the operation of the pump 22 and switches the switching valve 30. More practically, at time t23, the operation of the pump 22 is stopped and the switching valve 30 is switched, and communication between the canister connection passage 211 and the air passage 281 is established.

In S204, it is determined whether the detection value of the pressure sensor 24 is equal to the atmospheric pressure. At time t23, by stopping the operation of the pump 22 and switching the switching valve 30, the pressure detection passage 251 comes into communication with the atmosphere through the atmospheric system. When the air passage 281 is not clogged, the detection value of the pressure sensor 24 at time t24 is made substantially equal to the atmospheric pressure as shown in a solid line L21 of FIG. 5. On the other hand, when the air passage 281 is clogged, the detection value of the pressure sensor 24 at time t24 is kept to be lower than the atmospheric pressure by an influence of depressurizing in S202 as shown in a dotted line L22 of FIG. 5.

The detection value of the pressure sensor 24 at time t24 is recorded in the ECU 8 that serves as a "purge determination unit" and a "determination unit", and, when the detection value of the pressure sensor 24 at time t24 is substantially the same as the atmospheric pressure, the process proceeds to S205 based on a determination that there is no clogging in the air passage 281. When the detection value of the pressure sensor 24 at time t24 is lower than the atmospheric pressure, the process finishes a leak check based on a determination that there is a clogging in the air passage 281.

Then, in S205, the process starts the operation of the pump 22, switches the switching valve 30, and depressurizes the evaporation system. More practically, the process starts the operation of the pump 22 and switches the switching valve 30 after time t24 of FIG. 5. In such manner, the evaporation system is depressurized again. In S205, the pressure is decreased to a level that is lower than the first reference pressure, and the detection value of the pressure sensor 24 is recorded in the ECU 8 at time t25.

In S206, the process opens the purge valve 14. Since the evaporation system is being depressurized to a pressure that is lower than the first reference pressure at time t25, the atmosphere flows into the evaporation system through the intake air passage 161 when the purge valve 14 is opened.

In S207, it is determined whether the detection value of the pressure sensor 24 is equal to the atmospheric pressure. When the purge passage 131 is not clogged, the detection value of the pressure sensor 24 at time t26 is substantially the same as the atmospheric pressure as shown by a solid line L21 of FIG. 5. On the other hand, when the purge passage 131 is clogged, the detection value of the pressure sensor 24 at time t26 falls to a value lower than the atmospheric pressure as shown by a dotted line L23 of FIG. 5.

The detection value of the pressure sensor 24 at time t26 is recorded in the ECU 8, and, when the detection value of the pressure sensor 24 at time t26 is substantially the same as the atmospheric pressure, it is determined that there is no clogging in the purge passage 131, and the process proceeds to S208. When the detection value of the pressure sensor 24 at time t26 is lower than the atmospheric pressure, it is determined that there is a clogging in the purge passage 131, and the process finishes a leak check.

In S208, the process measures the second reference pressure. The process at time t26 closes the purge valve 14, switches the switching valve 30, and depressurizes the atmospheric system. The process records the detection value of the pressure sensor 24 in the ECU 8 during a period between time t26 and time t27, and uses such pressure as the second reference pressure. Further, the process compares (i) the detection value of the pressure sensor 24 at time t25 which has been detected in S205 and recorded in the ECU 8 with (ii) the second reference pressure that is detected in S208. When the detection value of the pressure sensor 24 at time t25 is lower than the second reference pressure, it is determined that the airtightness of the fuel tank 10 is sufficiently secured (i.e., no air leakage). On the other hand, when the detection value of the pressure sensor 24 at time t25 is higher than the second reference pressure, it is determined that the airtightness of the fuel tank 10 is not secured (i.e., air leakage).

In S209, the process stops the operation of the pump 22. That is, the ECU 8 stops the operation of the pressure sensor 24 after detecting that the pressure of the pressure detection passage 251 has returned to the atmospheric pressure, and finishes a leak check by returning to the initial state.

By the fuel vapor leakage detection method in the second embodiment, the clogging of the purge passage 131 and the clogging of the air passage 281 are continuously detected during a leak check of an engine stop time (i.e., when the engine 9 is stopped). In such manner, the fuel vapor leakage detection method in the second embodiment achieves the same effects as the first embodiment.

(Third Embodiment)

The fuel vapor leakage detection method in the third embodiment of the present disclosure is described with reference to FIGS. 6 and 7. The leak check procedure in the third embodiment is different from the procedure in the first embodiment. Further, like parts have like numbers in the first and third embodiments, for the brevity of the description.

Figure 6:
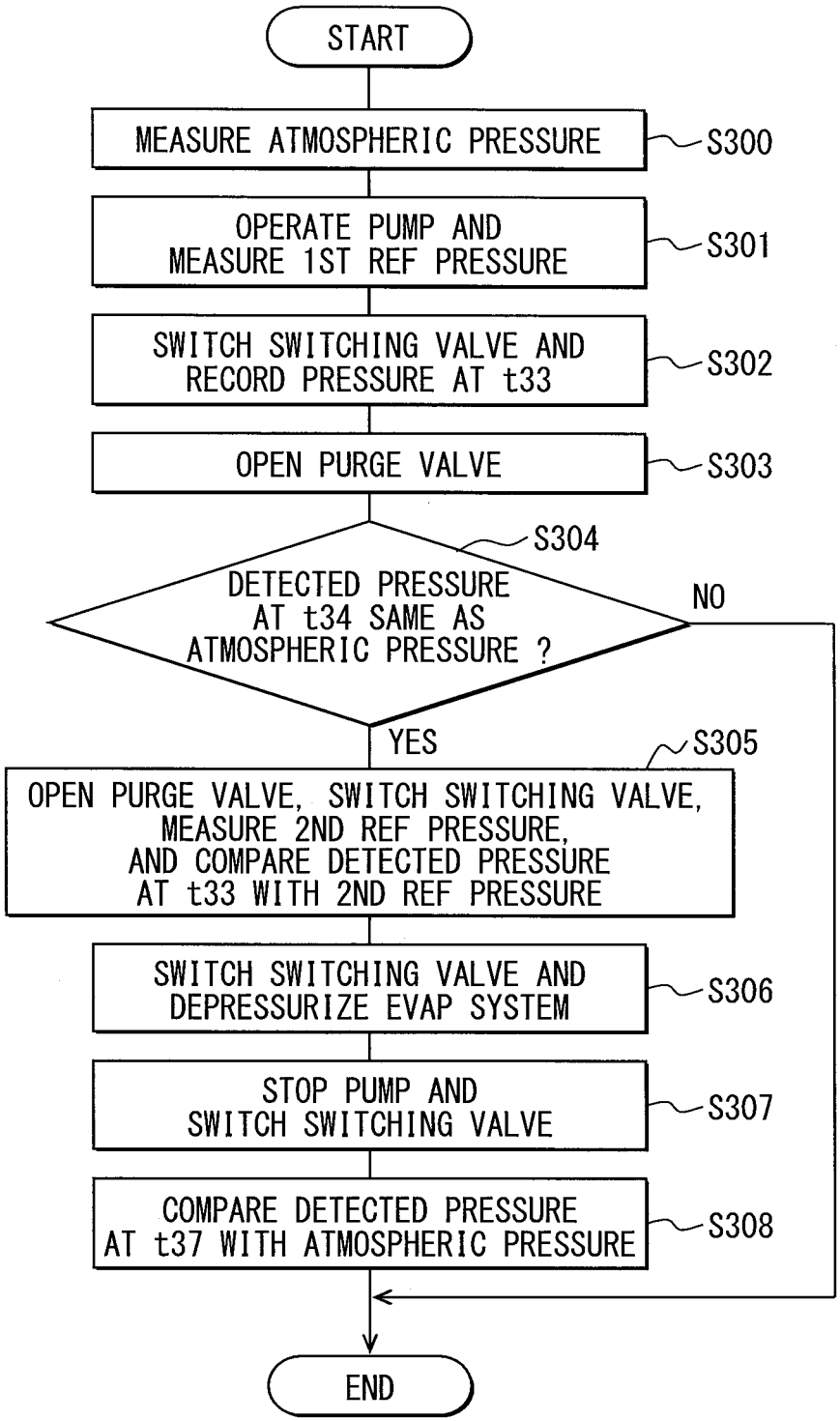
FIG. 6 is a flowchart of the fuel vapor leakage detection method in a third embodiment of the present disclosure.
Figure 7:
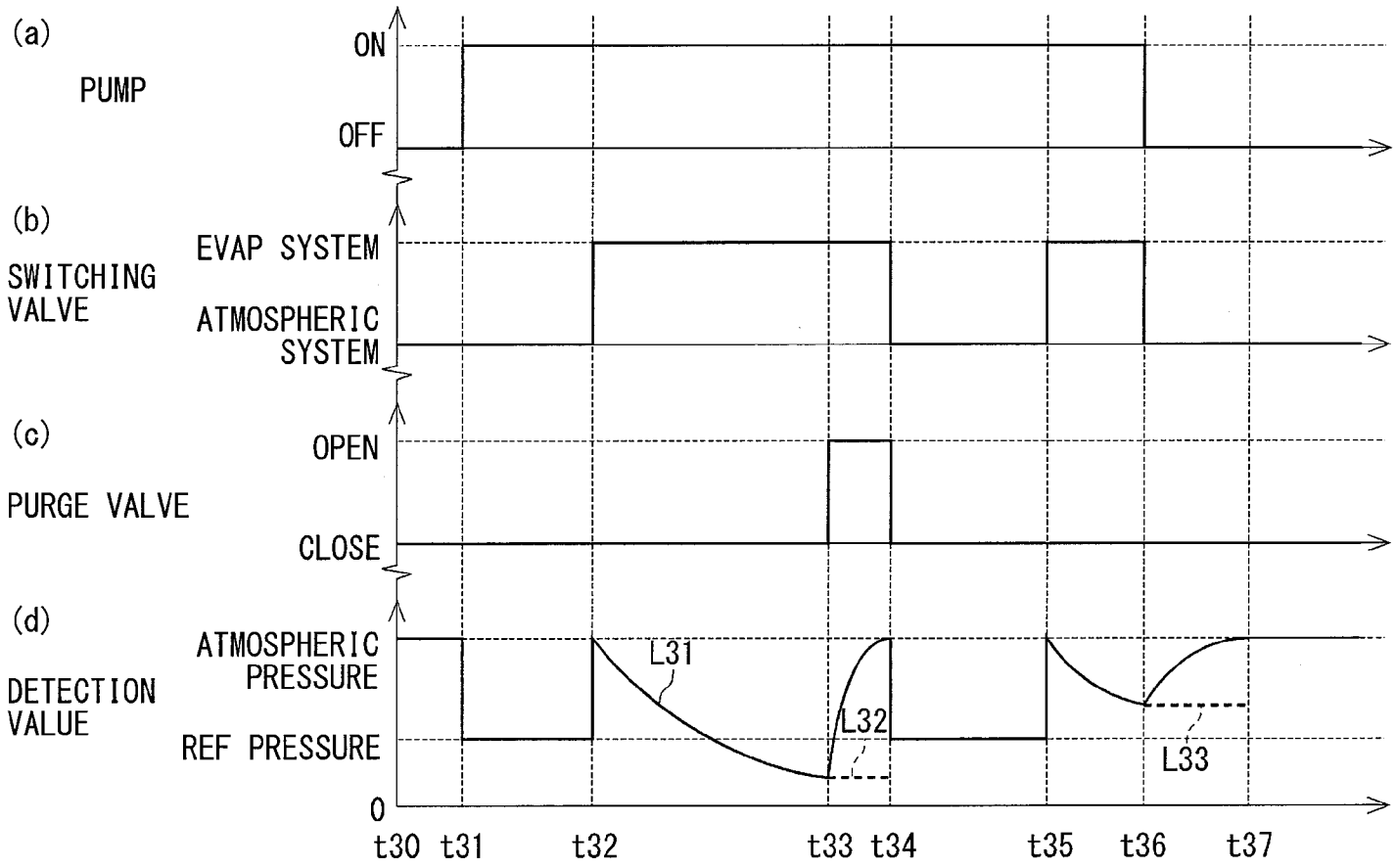
FIG. 7 is a time chart illustrating the operation of the pump, the switching valve and the purge valve together with the detection value of the pressure sensor in the fuel vapor leakage detection method in the third embodiment of the present disclosure.

FIG. 6 is a flowchart of the fuel vapor leakage detection method in the third embodiment of the present disclosure, which realizes a leak check process. FIG. 7 is an operation diagram of various parts in the leak check process of the third embodiment, including an operation state of the pump 22, a switching state of the switching valve 30, an opening and closing state of the purge valve 14, and time change of a detection value of the pressure sensor 24.

The leak check process of the third embodiment is performed similarly to the process of the leak check from step S100 to step S101 in the first embodiment. More practically, the process in S300 measures the atmospheric pressure during a period between time t30 to time t31 in FIG. 7. Then, in S301, the process measures the first reference pressure during a period between time t31 and time t32 in FIG. 7.

In S302, the process switches the switching valve 30, and depressurizes the evaporation system. That is, at time t32, by switching the switching valve 30, communication which does not pass through the switching valve bypass passage 261 is established among the pump 22, the pressure detection passage 251 and the evaporation system. In S302, the pressure is decreased to be lower than the first reference pressure, and the detection value of the pressure sensor 24 at time t33 is recorded in the ECU 8 as the "purge determination unit" and the "determination unit".

In S303, the process opens the purge valve 14. Since the evaporation system is being depressurized to a pressure that is lower than the first reference pressure, the atmosphere flows into the evaporation system through the intake air passage 161 when the purge valve 14 is opened at time of t33.

In S304, it is determined whether the detection value of the pressure sensor 24 is the same as the atmospheric pressure. When the purge passage 131 is not clogged, the detection value of the pressure sensor 24 at time t34 is substantially the same as the atmospheric pressure as shown by a solid line L31 of FIG. 7. On the other hand, when the purge passage 131 is clogged, the detection value of the pressure sensor 24 at time t34 is kept to be lower than the atmospheric pressure as shown by a dotted line L32 of FIG. 7, because the atmosphere flowing in from the intake air passage 161 does not reach the pressure detection passage 251.

The detection value of the pressure sensor 24 at time t34 is recorded in the ECU 8, and, when the detection value of the pressure sensor 24 at time t34 is substantially the same as the atmospheric pressure, it is determined that there is no clogging in the purge passage 131, and the process proceeds to S305. When the detection value of the pressure sensor 24 at time t34 is lower than the atmospheric pressure, it is determined that there is a clogging in the purge passage 131, and the process finishes a leak check.

In S305, the process closes the purge valve 14, switches the switching valve 30, and depressurizes the atmospheric system. The process records the detection value of the pressure sensor 24 in the ECU 8 during a period between time t34 and time t35, and uses such pressure as the second reference pressure.

Further, the process compares (i) the detection value of the pressure sensor 24 at time t33 which has been detected in S302 and recorded in the ECU 8 with (ii) the second reference pressure that is detected in S305. When the detection value of the pressure sensor 24 at time t33 is lower than the second reference pressure, it is determined that the airtightness of the fuel tank 10 is sufficiently secured (i.e., no air leakage). On the other hand, when the detection value of the pressure sensor 24 at time t33 is higher than the second reference pressure, it is determined that the airtightness of the fuel tank 10 is not being sufficient (i.e., air leakage).

In S306, the process switches the switching valve 30, and depressurizes the evaporation system. That is, at time t35, the process switches the switching valve 30, and establishes communication among the pump 22, the pressure detection passage 251 and the evaporation system, which does not pass through the switching valve bypass passage 261. At such moment, the pressure of the evaporation system falls to be lower than the atmospheric pressure, but does not fall to a level of the second reference pressure described above (i.e., at time t36 of FIG. 7).

In S307, the process stops the operation of the pump 22, and switches the switching valve 30. More practically, at time t36, the process switches the switching valve 30, and establishes communication between the canister connection passage 211 and the air passage 281.

In S308, it is determined whether the detection value of the pressure sensor 24 is the same as the atmospheric pressure. That is, at time t36, when the process stops the operation of the pump 22 and switches the switching valve 30, the pressure detection passage 251 comes into communication with the atmosphere through the atmospheric system. When the air passage 281 is not clogged, the detection value of the pressure sensor 24 at time t37 is substantially the same as the atmospheric pressure as shown by a solid line L31 of FIG. 7. On the other hand, when the air passage 281 is clogged, the detection value of the pressure sensor 24 at time t37 is kept to be lower than the atmospheric pressure under the influence of depressurizing in S306 as shown by a dotted line L33 of FIG. 7.

In S308, the ECU 8 compares the atmospheric pressure with the detection value of the pressure sensor 24 at time t37. The detection value of the pressure sensor 24 at time t37 is recorded in the ECU 8, and, when the detection value of the pressure sensor 24 at time t37 is substantially the same as the atmospheric pressure, it is determined that there is no clogging in the air passage 281. When the detection value of the pressure sensor 24 at time t37 is lower than the atmospheric pressure, it is determined that there is a clogging in the air passage 281.

In the leak check process of the third embodiment, the fuel vapor leakage detection device returns to the initial state at the end of S308, and a leak check is finished.

By the fuel vapor leakage detection method in the third embodiment, the clogging of the purge passage 131 and the clogging of the air passage 281 are continuously detected during a leak check of an engine stop time (i.e., when the engine 9 is stopped). In such manner, the fuel vapor leakage detection method in the third embodiment achieves the same effects as the first embodiment.

(Fourth Embodiment)

The fuel vapor leakage detection method in the third embodiment of the present disclosure is described with reference to FIGS. 8 and 9. The leak check procedure in the fourth embodiment is different from the procedure in the third embodiment. Further, like parts have like numbers in the third and fourth embodiments, for the brevity of the description.

Figure 8:
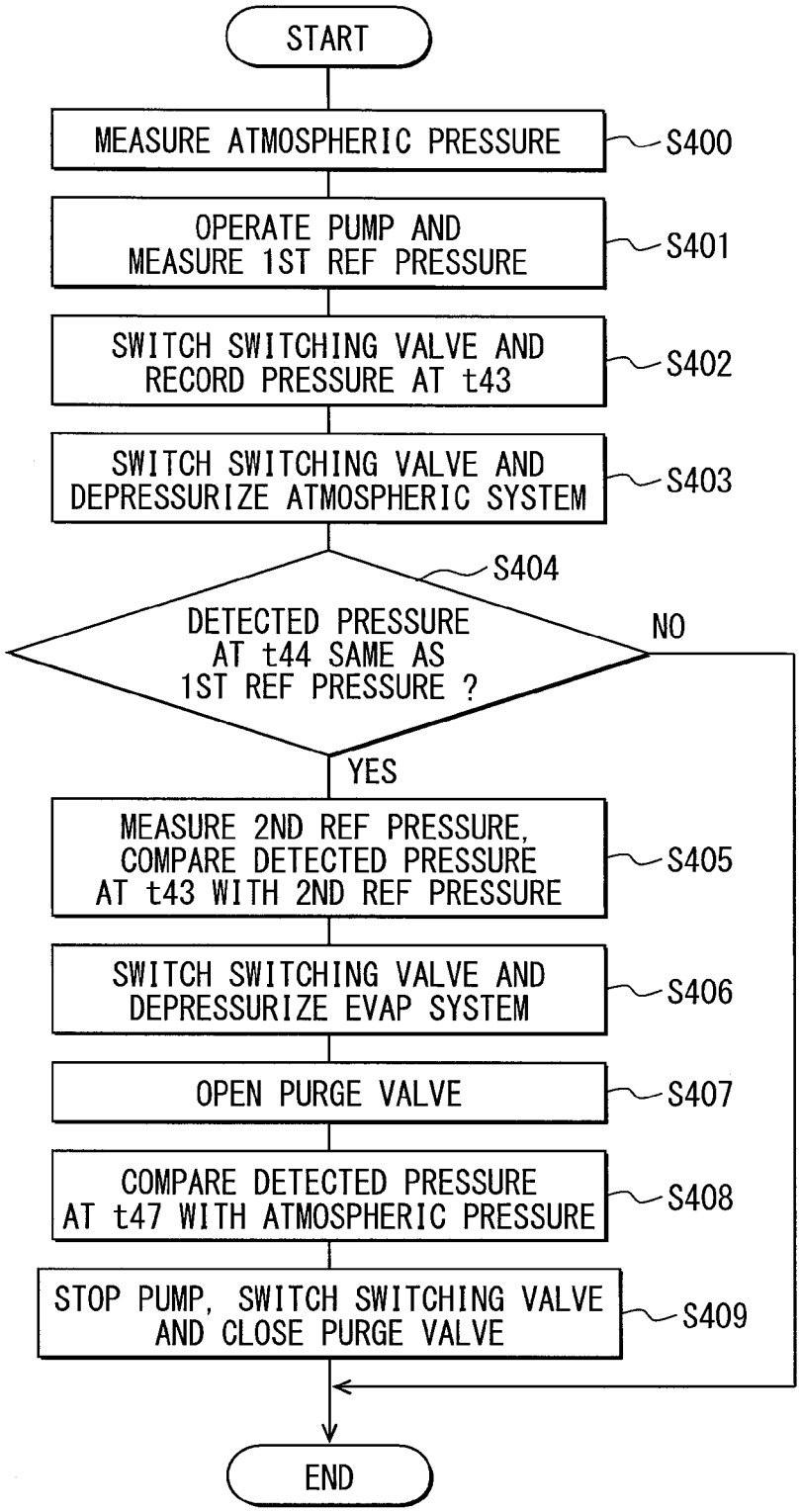
FIG. 8 is a flowchart of the fuel vapor leakage detection method in a fourth embodiment of the present disclosure.
Figure 9:
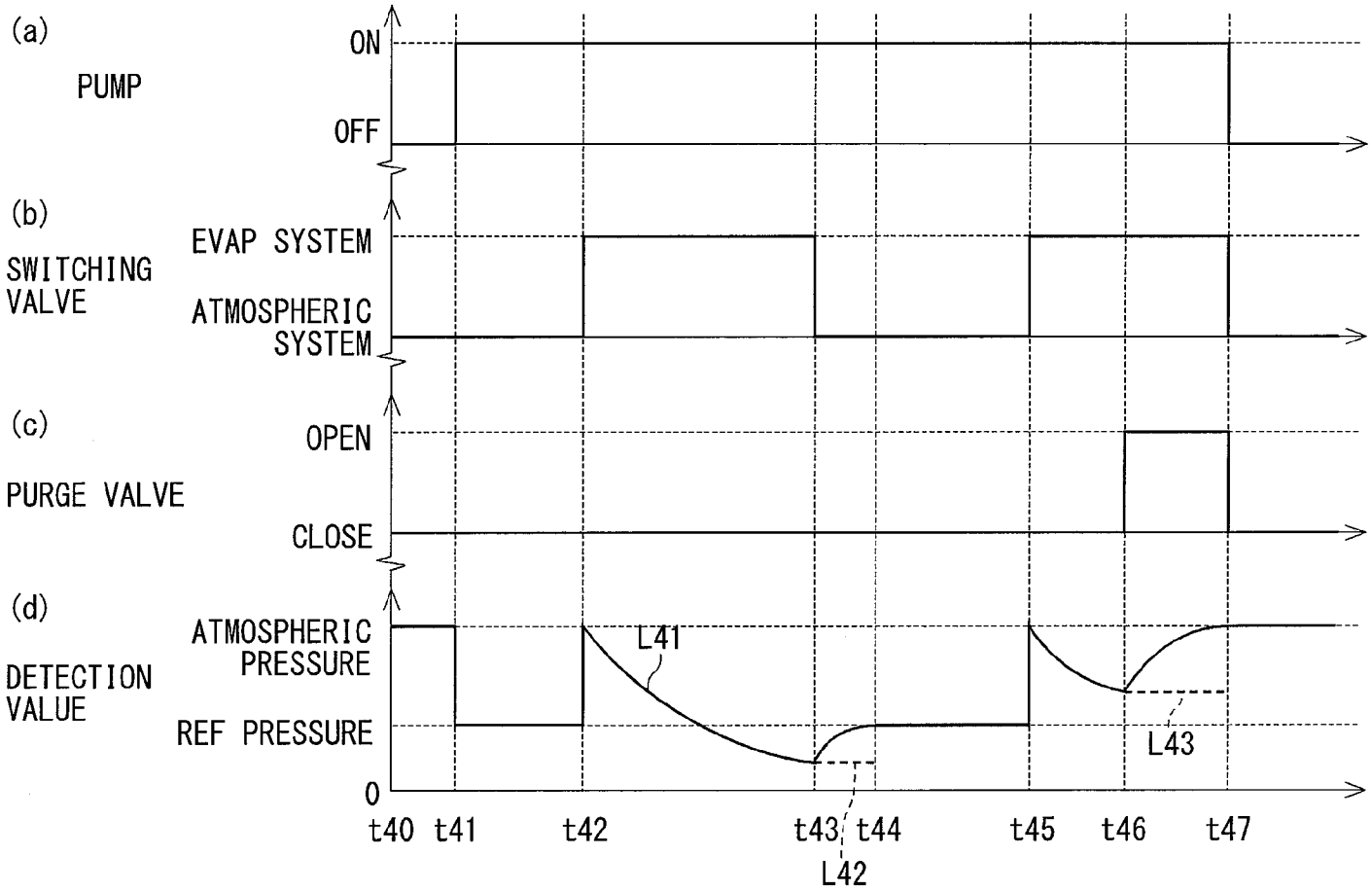
FIG. 9 is a time chart illustrating the operation of the pump, the switching valve and the purge valve together with the detection value of the pressure sensor in the fuel vapor leakage detection method in the fourth embodiment of the present disclosure.

FIG. 8 is a flowchart of the fuel vapor leakage detection method in the fourth embodiment of the present disclosure, which realizes a leak check process. FIG. 9 is an operation diagram of various parts in the leak check process of the fourth embodiment, including an operation state of the pump 22, a switching state of the switching valve 30, an opening and closing state of the purge valve 14, and time change of a detection value of the pressure sensor 24.

The leak check process of the fourth embodiment is performed similarly to the process of the leak check from step S300 to step S302 in the third embodiment. More practically, the process in S400 measures the atmospheric pressure during a period between time t40 and time t41 in FIG. 9. Then, in S401, the process operates the pump 22, and measures the first reference pressure during a period between time t41 and time t42 in FIG. 9. Then, in S402, the process switches the switching valve 30, and depressurizes the evaporation system to a level that is lower than the first reference pressure at time t42, and records the detection value of the pressure sensor 24 at time t43 in the ECU 8 as a "purge determination unit" and a "determination unit".

In S403, the process switches the switching valve 30, and depressurizes the atmospheric system. That is, after time t43, the process switches the switching valve 30, and establishes communication between the canister connection passage 211 and the air passage 281. Then, the process continues to depressurize the air passage 281 until time t44.

In S404, the process determines whether the detection value of the pressure sensor 24 is the same as the first reference pressure. When the air passage 281 is not clogged, the detection value of the pressure sensor 24 at time t44 is substantially the same as the first reference pressure as shown in a solid line L41 of FIG. 9. On the other hand, when the air passage 281 is clogged, the detection value of the pressure sensor 24 at time t44 is lower than the first reference pressure as shown as a dotted line L42 of FIG. 9.

The detection value of the pressure sensor 24 at time t44 is recorded in the ECU 8, and, when the detection value of the pressure sensor 24 at time t44 is substantially the same as the first reference pressure, it is determined that there is no clogging in the air passage 281, and the process proceeds to S405. When the detection value of the pressure sensor 24 at time t44 is lower than the first reference pressure, it is determined that there is a clogging in the air passage 281, and the process finishes a leak check.

In S405, the process measures the second reference pressure. That is, subsequent to S404, the pump 22 sucks atmospheric air through the air filter 23 and the atmospheric system. The detection value of the pressure sensor 24 during a period between time t44 and time t45 in FIG. 9 is recorded in the ECU 8, and is used as the second reference pressure.

Further, the process compares (i) the detection value of the pressure sensor 24 at time t43 which is detected in S402 and recorded in the ECU 8 with (ii) the second reference pressure which is detected in S405. When the detection value of the pressure sensor 24 at time t43 is lower than the second reference pressure, it is determined that the airtightness of the fuel tank 10 is sufficiently secured (i.e., no air leakage). On the other hand, when the detection value of the pressure sensor 24 at time t43 is higher than the second reference pressure, it is determined that the airtightness of the fuel tank 10 is not sufficiently secured (i.e., air leakage).

In S406, the process switches the switching valve 30, and depressurizes the evaporation system. That is, at time t45 of FIG. 9, the process switches the switching valve 30, and establishes communication among the pump 22, the pressure detection passage 251 and the evaporation system, which does not pass through the switching valve bypass passage 261. At such moment, the pressure of the evaporation system falls to be lower than the atmospheric pressure, but does not fall to a level of the second reference pressure described above.

In S407, the process opens the purge valve 14. Since the evaporation system is being depressurized to be lower than the atmospheric pressure at time t46, the atmosphere flows into the evaporation system through the intake air passage 161 when the purge valve 14 is opened.

In S408, it is determined whether the detection value of the pressure sensor 24 is the same as the atmospheric pressure. When the purge valve 14 is opened at time t46, the atmosphere flows into the evaporation system. When the purge passage 131 is not clogged, the detection value of the pressure sensor 24 at time t47 is substantially the same as the atmospheric pressure as shown by a solid line L41 of FIG. 9. On the other hand, when the purge passage 131 is clogged, the detection value of the pressure sensor 24 at time t47 is lower than the atmospheric pressure as shown by a dotted line L43 of FIG. 9.

The detection value of the pressure sensor 24 at time t47 is recorded in the ECU 8, and, when the detection value of the pressure sensor 24 at time t47 is substantially the same as the atmospheric pressure, it is determined that there is no clogging in the purge passage 131. Further, when the detection value of the pressure sensor 24 at time t47 is lower than the atmospheric pressure, it is determined that there is a clogging in the purge passage 131.

In S409, the process stops the operation of the pump 22, switches the switching valve 30 to establish communication between the canister connection passage 211 and the air passage 281, and closes the purge valve 14. The ECU 8 stops the operation of the pressure sensor 24 after detecting that the pressure of the pressure detection passage 251 has returned to the atmospheric pressure. In such manner, the fuel vapor leakage detection device, which has performed a leak check in the fourth embodiment, returns to the initial state, and the leak check is concluded.

By the fuel vapor leakage detection method in the fourth embodiment, the clogging of the purge passage 131 and the clogging of the air passage 281 are detected during a leak check of an engine stop time (i.e., when the engine 9 is stopped). In such manner, the fuel vapor leakage detection method in the fourth embodiment achieves the same effects as the first embodiment.

(Fifth Embodiment)

The fuel vapor leakage detection device in the fifth embodiment of the present disclosure is described with reference to FIGS. 10 and 11 in the following. The fifth embodiment is different from the first embodiment with regards to pump operation, that is, an operation state of the pump 22, for a detection of the clogging of the air passage. Further, like parts have like numbers in the first and fifth embodiments, for the brevity of the description.

Figure 10:
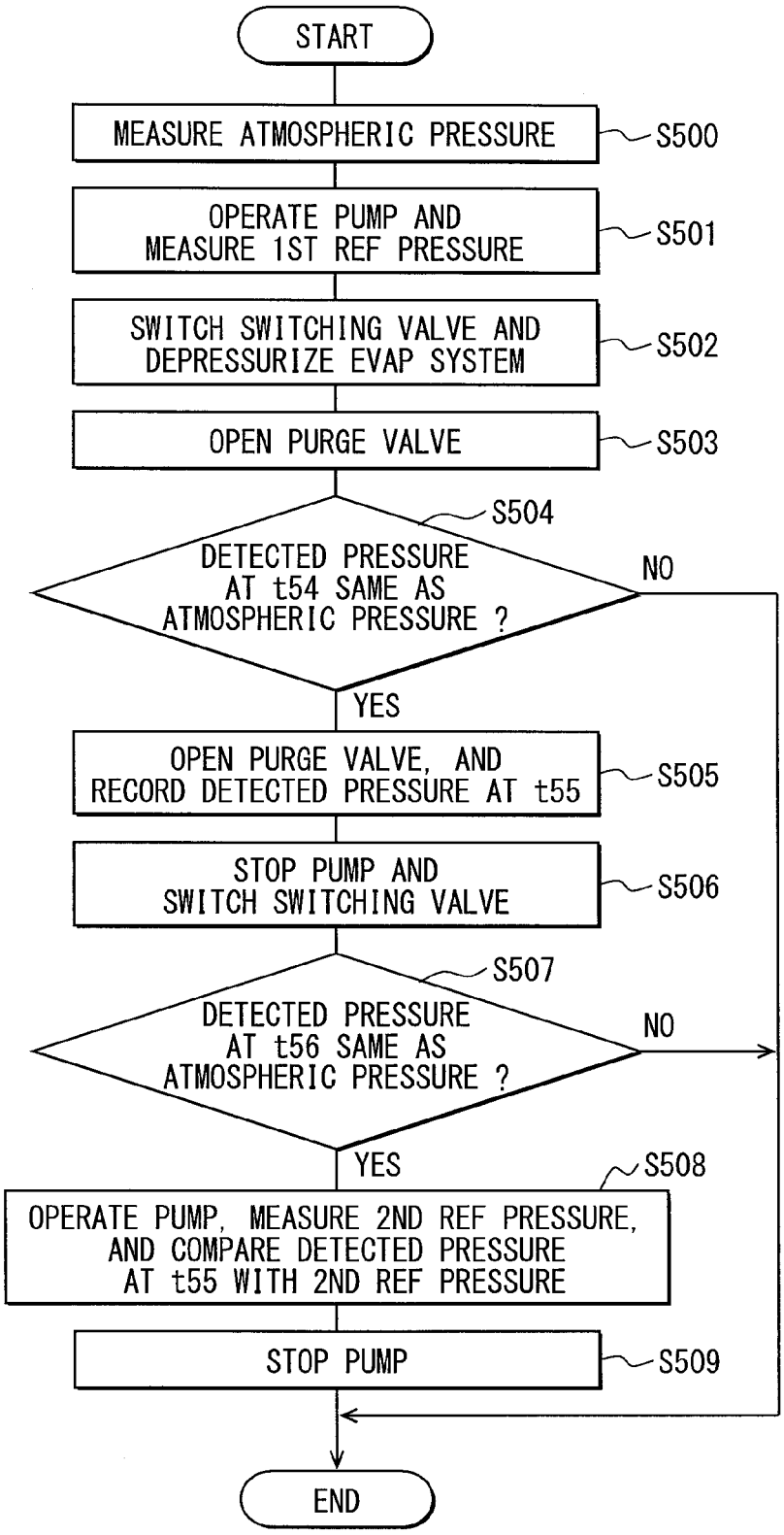
FIG. 10 is a flowchart of the fuel vapor leakage detection method in a fifth embodiment of the present disclosure.
Figure 11:
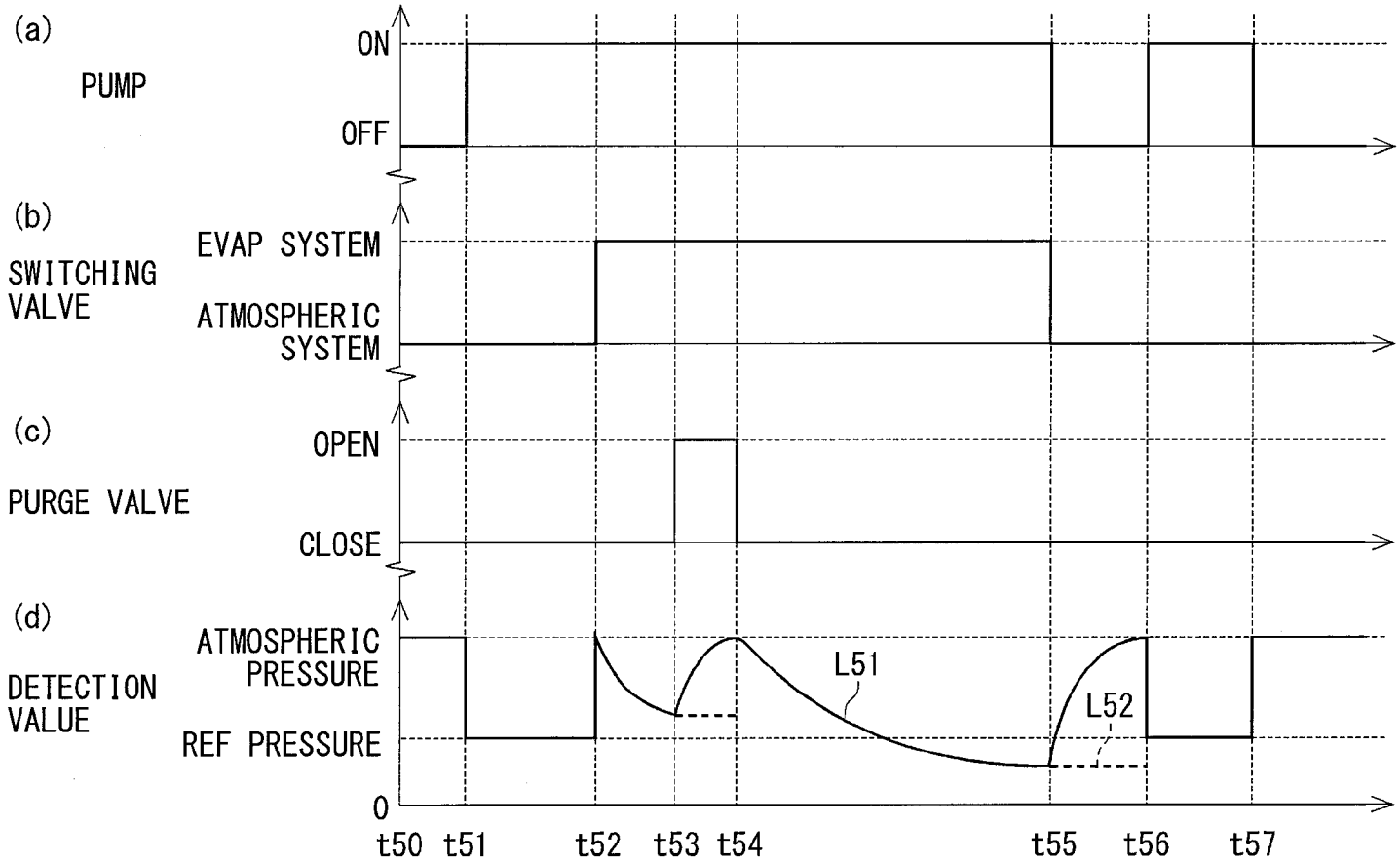
FIG. 11 is a time chart illustrating the operation of the pump, the switching valve and the purge valve together with the detection value of the pressure sensor in the fuel vapor leakage detection method in the fifth embodiment of the present disclosure.

FIG. 10 is a flowchart of the fuel vapor leakage detection method in the fifth embodiment of the present disclosure, which realizes a leak check process. FIG. 11 is an operation diagram of various parts in the leak check process of the fifth embodiment, including an operation state of the pump 22, a switching state of the switching valve 30, an opening and closing state of the purge valve 14, and time change of a detection value of the pressure sensor 24.

The leak check process of step S500 to step S501 in the fifth embodiment is performed similarly to the process of the leak check from step S100 to step S105 in the first embodiment. More practically, the process in S500 measures the atmospheric pressure during a period between time t50 and time t51 in FIG. 11. Then, in S501, the process operates the pump 22, and measures the first reference pressure during a period between time t51 and time t52 in FIG. 11. Then, in S502, the process switches the switching valve 30, and depressurizes the evaporation system to have a pressure that is lower than the atmospheric pressure during a period between time t52 and time t53. Then, in S503, the process opens the purge valve at time t53. Then, in S504, the clogging of the purge passage 131 is determined by the ECU 8 which serves as a "purge determination unit" or a "determination unit" at time t54 in FIG. 11. Then, in S504 which serves as a leak check procedure, the evaporation system is depressurized by the opening of the purge valve 14, and the detection value of the pressure sensor 24 at time t55 is recorded in the ECU 8 during a period between time t54 and time t55 in FIG. 11.

In S506, the process stops the operation of the pump 22, and switches the switching valve 30. That is, at time t55, the process switches the switching valve 30, and establishes communication between the canister connection passage 211 and the air passage 281.

In S507, it is determined whether the detection value of the pressure sensor 24 is the same as the atmospheric pressure. When the process stops the operation of the pump 22 and switches the switching valve 30 at time t55, the pressure detection passage 251 comes into communication with the atmosphere through the atmospheric system. When the air passage 281 is not clogged, the detection value of the pressure sensor 24 at time t56 is substantially the same as the atmospheric pressure as shown by a solid line L51 of FIG. 11. On the other hand, when the air passage 281 is clogged, the detection value of the pressure sensor 24 at time t56 falls to be lower than the atmospheric pressure as shown by a dotted line L52 of FIG. 11.

The detection value of the pressure sensor 24 at time t56 is recorded in the ECU 8, and, when the detection value of the pressure sensor 24 at time t56 is substantially the same as the atmospheric pressure, it is determined that there is no clogging in the air passage 281, and the process proceeds to S508. When the detection value of the pressure sensor 24 at time t56 is lower than the atmospheric pressure, it is determined that there is a clogging in the air passage 281, and the process finishes a leak check.

In S508, the process operates the pump 22, and measures the second reference pressure. The pump 22 sucks atmospheric air through the air filter 23 and the atmospheric system when it is operated. The process records the detection value of the pressure sensor 24 in the ECU 8 during a period between time t56 and time t57, and uses such value as the second reference pressure.

Further, the process compares (i) the detection value of the pressure sensor 24 at time t55 which is detected in S505 and recorded in the ECU 8 with (ii) the second reference pressure that is detected in S508. When the detection value of the pressure sensor 24 at time t55 is lower than the second reference pressure, it is determined that the airtightness of the fuel tank 10 is sufficiently secured (i.e., no air leakage). On the other hand, when the detection value of the pressure sensor 24 at time t55 is higher than the second reference pressure, it is determined that the airtightness of the fuel tank 10 is not sufficiently secured (i.e., air leakage).

In S509, the process stops the operation of the pump 22. The ECU 8 stops the operation of the pressure sensor 24 after detecting that the pressure of the pressure detection passage 251 has returned to the atmospheric pressure. In such manner, the fuel vapor leakage detection device returns to the initial state, and finishes a leak check.

By the fuel vapor leakage detection method in the fifth embodiment, the clogging of the purge passage 131 and the clogging of the air passage 281 are detected during a leak check of an engine stop time (i.e., when the engine 9 is stopped). In such manner, the fuel vapor leakage detection method in the fifth embodiment achieves the same effects as the first embodiment.

(Sixth Embodiment)

The fuel vapor leakage detection device in the sixth embodiment of the present disclosure is described with reference to FIGS. 12 and 13 in the following. The sixth embodiment is different from the fourth embodiment with regards to a pump operation, that is, an operation state of the pump 22, for a detection of the clogging of the air passage. Further, like parts have like numbers in the fourth and sixth embodiments, for the brevity of the description.

Figure 12:
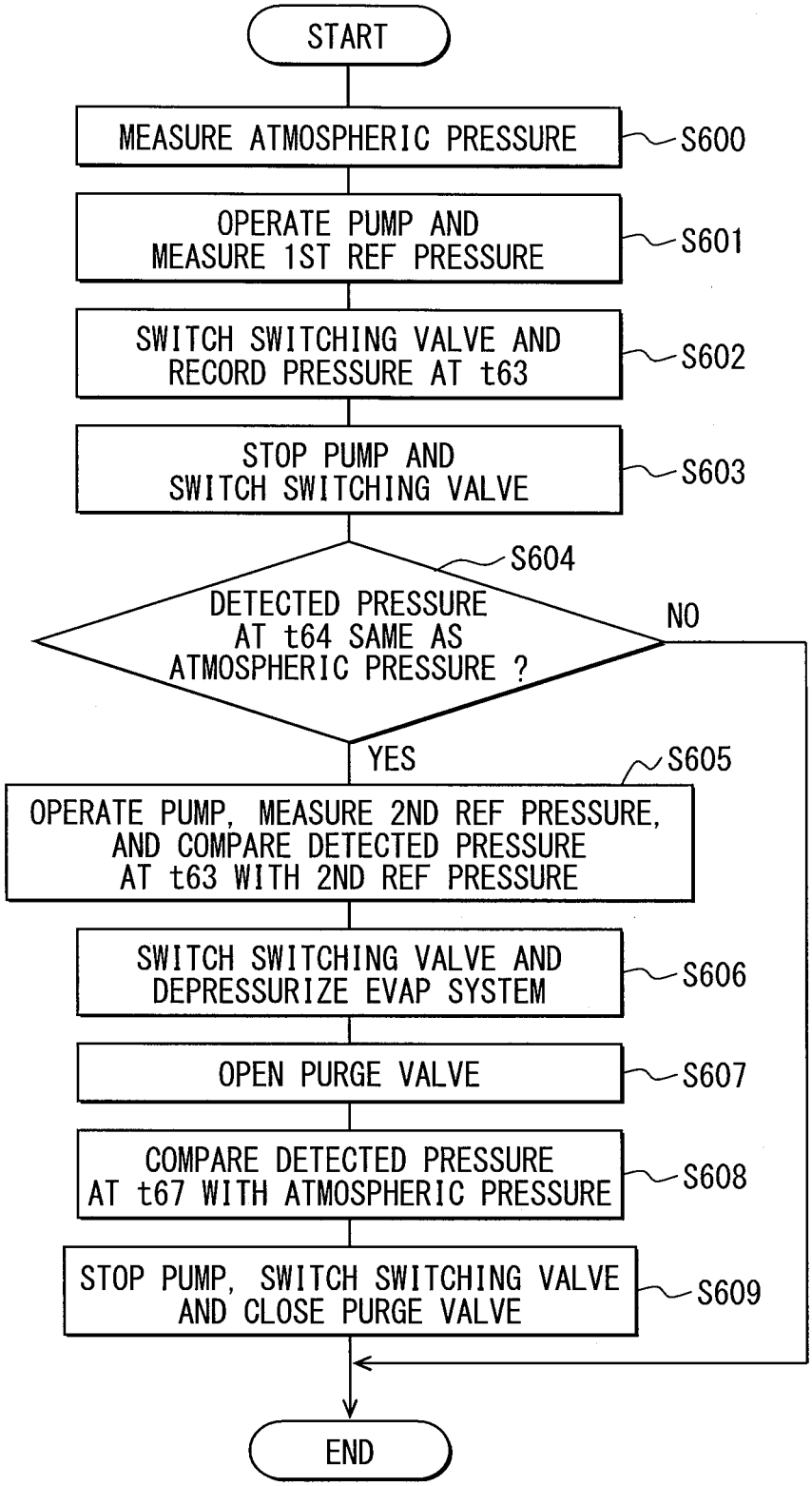
FIG. 12 is a flowchart of the fuel vapor leakage detection method in a sixth embodiment of the present disclosure.
Figure 13:
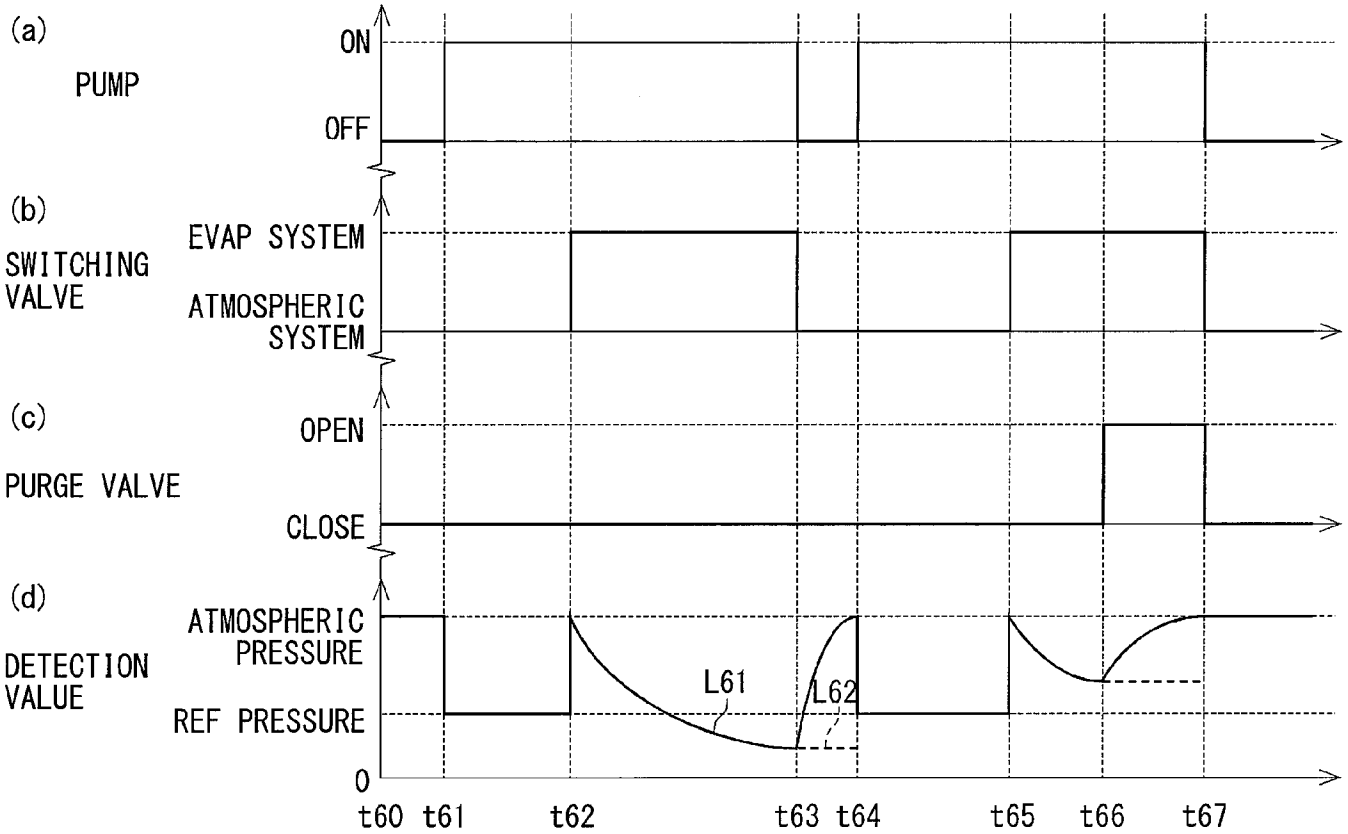
FIG. 13 is a time chart illustrating the operation of the pump, the switching valve and the purge valve together with the detection value of the pressure sensor in the fuel vapor leakage detection method in the sixth embodiment of the present disclosure.

FIG. 12 is a flowchart of the fuel vapor leakage detection method in the sixth embodiment of the present disclosure, which realizes a leak check process. FIG. 13 is an operation diagram of various parts in the leak check process of the sixth embodiment, including an operation state of the pump 22, a switching state of the switching valve 30, an opening and closing state of the purge valve 14, and time change of a detection value of the pressure sensor 24.

The leak check process of step S600 to step S601 in the sixth embodiment is performed similarly to the process of the leak check from step S400 to step S405 in the fourth embodiment. More practically, the process in S600 measures the atmospheric pressure during a period between time t60 and time t61 in FIG. 13. Then, in S601, the process operates the pump 22, and measures the first reference pressure during a period between time t61 and time t62 in FIG. 13. Then, in S602, the process switches the switching valve 30, and depressurizes the evaporation system to have a pressure that is lower than the first reference pressure, and records the detection value of the pressure sensor 24 at time t63 in the ECU 8 that serves as a "purge determination unit" and a "determination unit" during a period between time t62 and time t63 in FIG. 13.

In S603, the process stops the operation of the pump 22, and switches the switching valve 30, and depressurizes the air passage 281. That is, after time t63, the process switches the switching valve 30, and establishes communication between the canister connection passage 211 and the air passage 281. Then, the process further depressurizes the air passage 281 until time t64.

In S604, it is determined whether the detection value of the pressure sensor 24 is the same as the atmospheric pressure. When the air passage 281 is not clogged, the detection value of the pressure sensor 24 at time t64 is substantially the same as the atmospheric pressure as shown by a solid line L61 of FIG. 13. On the other hand, when the air passage 281 is clogged, the detection value of the pressure sensor 24 at time t64 is a value that is lower than the atmospheric pressure as shown by a dotted line L62 of FIG. 13.

The detection value of the pressure sensor 24 at time t64 is recorded in the ECU 8, and it is determined that there is no clogging in the air passage 281, and, when the detection value of the pressure sensor 24 at time t64 is substantially the same as the atmospheric pressure, the process proceeds to S605. When the detection value of the pressure sensor 24 at time t64 is lower than the atmospheric pressure, it is determined that there is a clogging in the air passage 281, and the process finishes a leak check.

In S605, the process starts the operation of the pump 22, and measures the second reference pressure. The pump 22 sucks atmospheric air through the air filter 23 and the atmospheric system when the pump 22 is operated. The detection value of the pressure sensor 24 during a period between time t64 and time t65 of FIG. 13 is recorded in the ECU 8, and is used as the second reference pressure.

Further, the compares (i) the detection value of the pressure sensor 24 at time t63 which is detected in S602 and recorded in the ECU 8 with (ii) the second reference pressure which is detected in S605. When the detection value of the pressure sensor 24 at time t63 is lower than the second reference pressure, it is determined that the airtightness of the fuel tank 10 is sufficiently secured (i.e., no air leakage). On the other hand, when the detection value of the pressure sensor 24 at time t63 is higher than the second reference pressure, it is determined that the airtightness of the fuel tank 10 is not sufficiently secured (i.e., air leakage).

The process in step S606 to step S608 is performed in the same manner as the process of a leak check in step S406 to step S408 in the fourth embodiment.

By the fuel vapor leakage detection method in the sixth embodiment, the clogging of the purge passage 131 and the clogging of the air passage 281 are detected during a leak check of an engine stop time (i.e., when the engine 9 is stopped). In such manner, the fuel vapor leakage detection method in the sixth embodiment achieves the same effects as the first embodiment.

(Seventh Embodiment)

The fuel vapor leakage detection device in the seventh embodiment of the present disclosure is described with reference to FIGS. 14 and 15 in the following. The seventh embodiment is different from the first embodiment with regards to a clogging determination criteria for determining the clogging of the purge/air passage. Further, like parts have like numbers in the first and seventh embodiments, for the brevity of the description.

Figure 14:
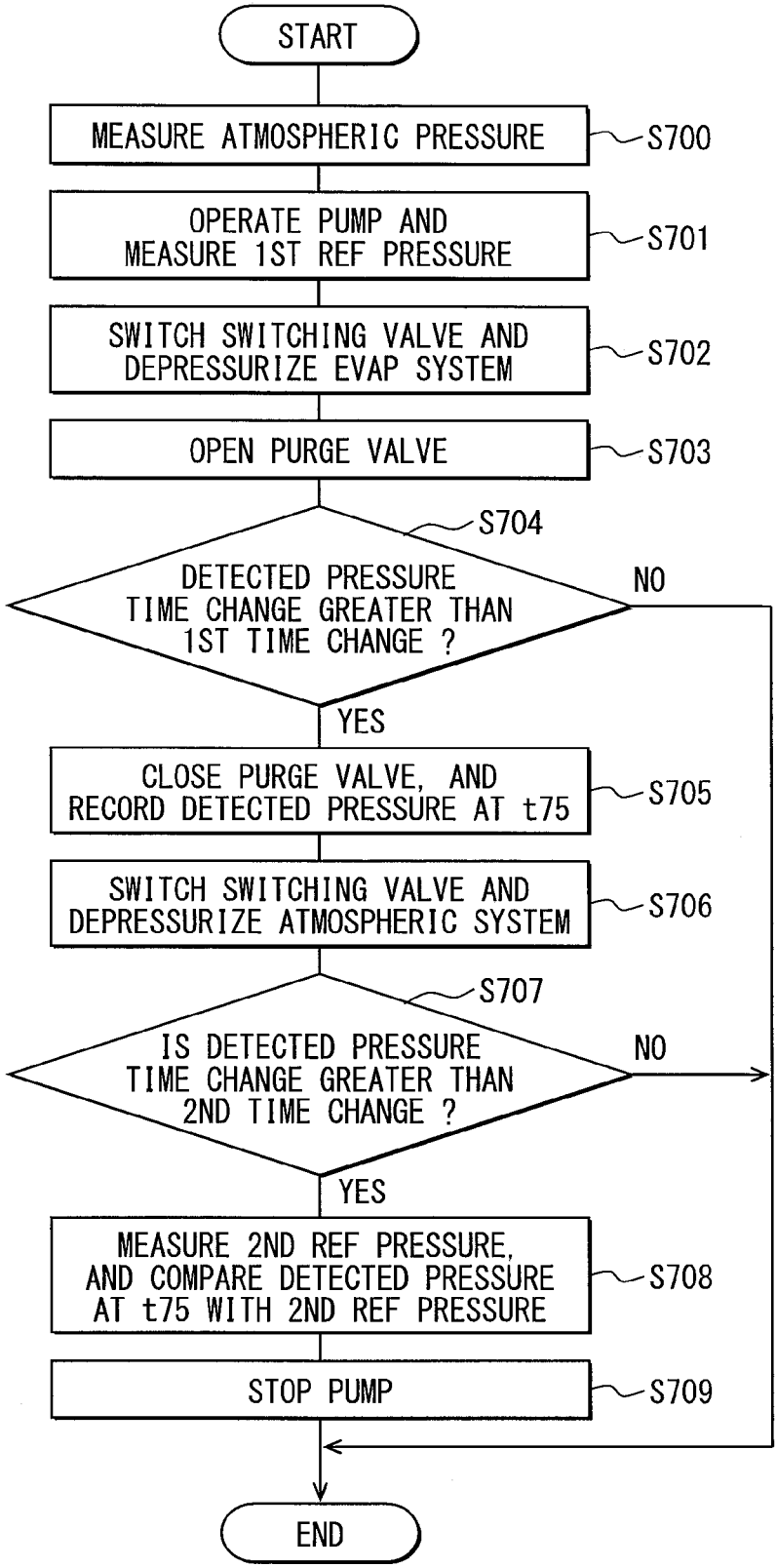
FIG. 14 is a flowchart of the fuel vapor leakage detection method in a seventh embodiment of the present disclosure.
Figure 15:
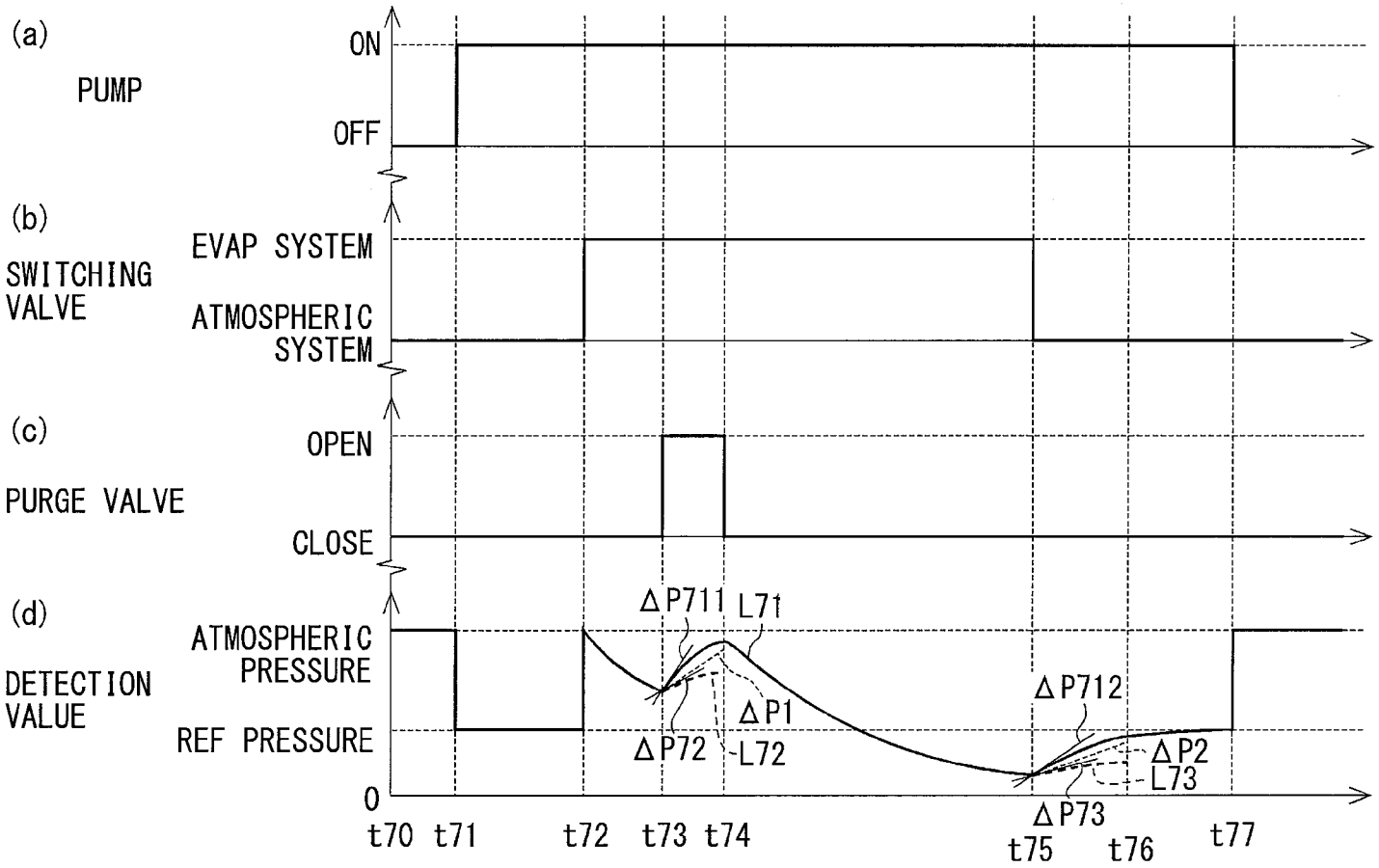
FIG. 15 is a time chart illustrating the operation of the pump, the switching valve and the purge valve together with the detection value of the pressure sensor in the fuel vapor leakage detection method in the seventh embodiment of the present disclosure.

FIG. 14 is a flowchart of the fuel vapor leakage detection method in the seventh embodiment, which realizes a leak check process. FIG. 15 is an operation diagram of various parts in the leak check process of the seventh embodiment, including an operation state of the pump 22, a switching state of the switching valve 30, an opening and closing state of the purge valve 14, and time change of a detection value of the pressure sensor 24.

The leak check process of the seventh embodiment is performed similarly to the process of the leak check from step S100 to step S103 in the first embodiment. More practically, the process in S700 measures the atmospheric pressure (i.e., during a period between time t70 and time t71 in FIG. 15). Then, in S701, the process operates the pump 22, and measures the first reference pressure (i.e., during a period between time t71 and time t72 in FIG. 15). Then, in S702, the process switches the switching valve 30, and depressurizes the evaporations opens the purge valve 14 (i.e., at time t73).

In S704, it is determined whether a time change of the detection value of the pressure sensor 24 is greater than a predetermined first time change API. When the purge passage 131 is not clogged, the pressure of a purge system quickly recovers because the atmosphere flows into the purge system through the intake passage 16 when the purge valve 14 opens. Therefore, a time change ΔP of a pressure of the purge system after the opening of the purge valve 14 is greater than the predetermined first time change ΔP1. More practically, as shown in FIG. 15, a time change ΔP711 that is represented as a tangential line of a solid line L71 just after time t73 in FIG. 15 is greater than the first time change ΔP1. On the other hand, when the purge passage 131 is clogged, even after the opening of the purge valve 14, the atmosphere is hindered from flowing into the purge system, thereby making the time change of the pressure in the purge system to have a very slow increase or no increase. Therefore, in such case, the time change ΔP of a pressure of the purge system after the opening of the purge valve 14 is equal to or smaller than the predetermined first time change ΔP1. More practically, a time change ΔP72 that is represented as a tangential line of a dotted line L72 just after t73 is equal to or smaller than the first time change ΔP1 as shown in FIG. 15.

The detection value of the pressure sensor 24 during a period between time t73 and time t74 is recorded in the ECU 8 that serves as a "purge determination unit" in the claims, and, when the time change ΔP of the detection value of the pressure sensor 24 just after time t73 is greater than the first time change ΔP1, it is determined that there is no clogging in the purge passage 131, and the process proceeds to S705. When the time change ΔP of the detection value of the pressure sensor 24 just after time t73 is equal to or smaller than the first time change ΔP1, it is determined that there is a clogging in the purge passage 131, and the process finishes a leak check.

Then, just like the leak check S105 in the first embodiment, in S705, after closing the purge valve 14 and depressurizing the evaporation system, the process records the detection value of the pressure sensor 24 at time t75 in the ECU 8. Then, just like the leak check S106 in the first embodiment, the process switches the switching valve 30 in S706, and depressurizes the atmospheric system.

In S707, it is determined whether a time change of the detection value of the pressure sensor 24 is greater than a predetermined second time change ΔP2. When the air passage 281 is not clogged, the pressure of the atmospheric system quickly recovers because the atmosphere flows into the atmospheric system through the air filter 23. Therefore, a time change ΔP of a pressure of the atmospheric system after the switching of the switching valve 30 is greater than the predetermined second time change ΔP2. More practically, as shown in FIG. 15, a time change ΔP712 that is represented as a tangential line of a solid line L71 just after time t75 in FIG. 15 is greater than the second time change ΔP2. On the other hand, when the air passage 281 is clogged, even after the switching of the switching valve 30, the atmosphere is hindered to flow into the atmospheric system, thereby making the time change of the pressure in the atmospheric system to have a very slow increase or no increase. Therefore, in such case, the time change ΔP of a pressure of the atmospheric system after the switching of the switching valve 30 is equal to or smaller than the predetermined second time change ΔP2. More practically, a time change ΔP73 that is represented as a tangential line of a dotted line L73 just after time t75 is equal to or smaller than the second time change ΔP2 in FIG. 15.

The detection value of the pressure sensor 24 during a period between time t75 and time t76 is recorded in the ECU 8 that serves as a "purge determination unit", and, when the time change ΔP of the detection value of the pressure sensor 24 just after time t75 is greater than the second time change ΔP2, it is determined that there is no clogging in the atmospheric passage 281, and the process proceeds to S708. When the time change ΔP of the detection value of the pressure sensor 24 just after time t75 is equal to or smaller than the second time change ΔP2, it is determined that there is a clogging in the air passage 281, and the process finishes a leak check.

Then, similarly to S108 of a leak check in the first embodiment, the process measures, in a leak check in S708, the second reference value, and compares (i) the second reference value with (ii) the detection value of the pressure sensor 24 at time t75 which is detected in S705. Then, similarly to S109 of a leak check in the first embodiment, the process stops the operation of the pump 22, and finishes a leak check (i.e., at time t77 of FIG. 15).

In the fuel vapor leakage detection method of the seventh embodiment, the process detects the clogging of the purge passage 131 and the clogging of the air passage 281 during a leak check at an engine stop time (i.e., when the engine 9 is stopped). In such manner, the fuel vapor leakage detection method in the seventh embodiment achieves the same effects as the first embodiment.

Further, in the fuel vapor leakage detection method of the seventh embodiment, the clogging of the purge passage 131 and the clogging of the air passage 281 are detected based on a large-small (i.e., magnitude) relationship between a time change ΔP of the detection value of the of the pressure sensor 24 and a predetermined time change (i.e., a threshold value). In such manner, in comparison to the fuel vapor leakage detection method of the first embodiment, a waiting time while waiting for (i.e., having) a stabilized pressure in the purge passage 131 and the air passage 281 is no longer required, and an operation time of the pump is shortened. Therefore, power consumption by the operation of the pressure sensor and the pump can be reduced.

(Eighth Embodiment)

The fuel vapor leakage detection device in the eighth embodiment of the present disclosure is described with reference to FIGS. 16 and 17 in the following. The eighth embodiment is different from the second embodiment with regards to a clogging determination criteria for determining the clogging of the purge/air passage. Further, like parts have like numbers in the second and eighth embodiments, for the brevity of the description.

Figure 16:
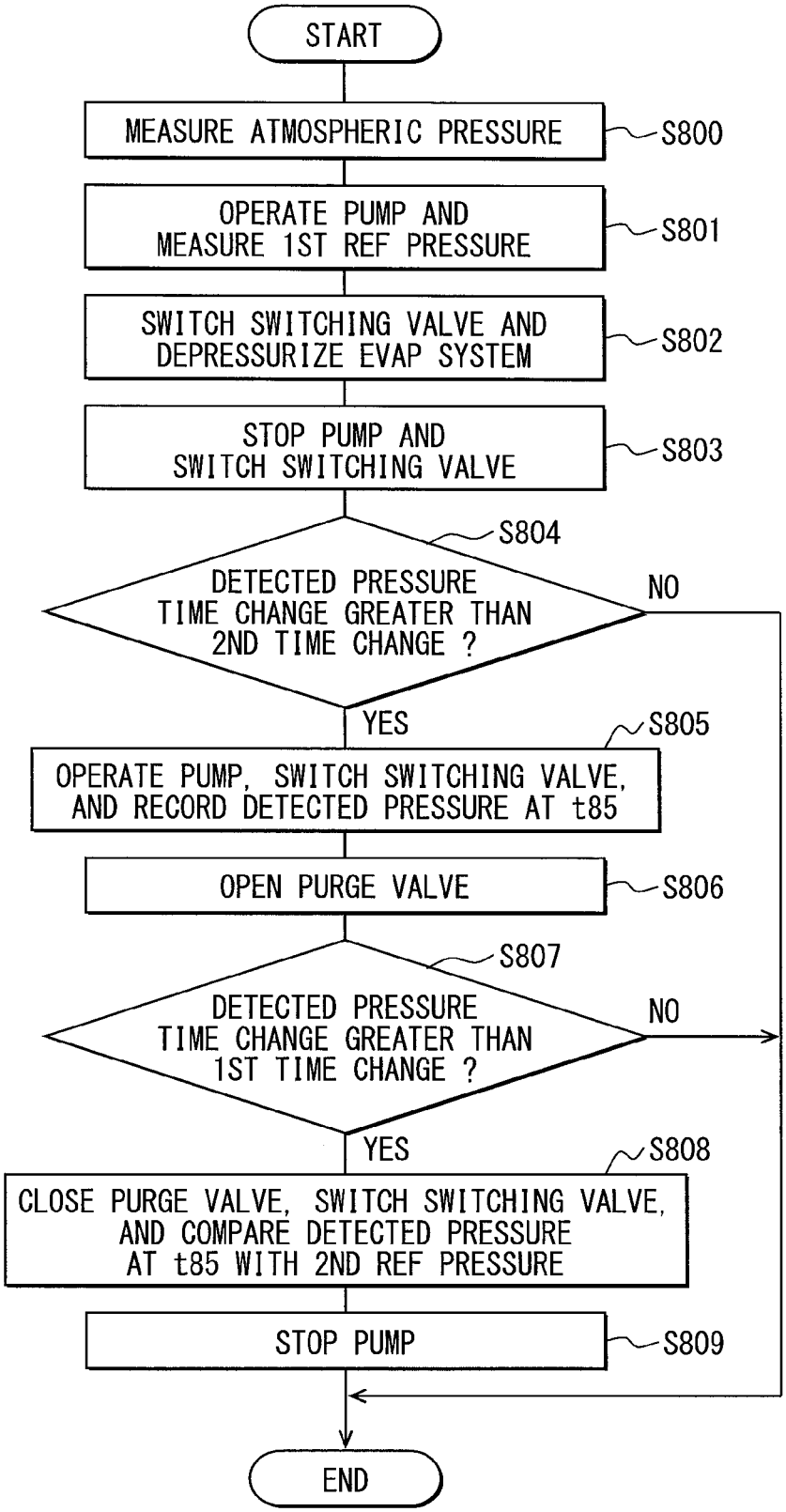
FIG. 16 is a flowchart of the fuel vapor leakage detection method in an eighth embodiment of the present disclosure.
Figure 17:
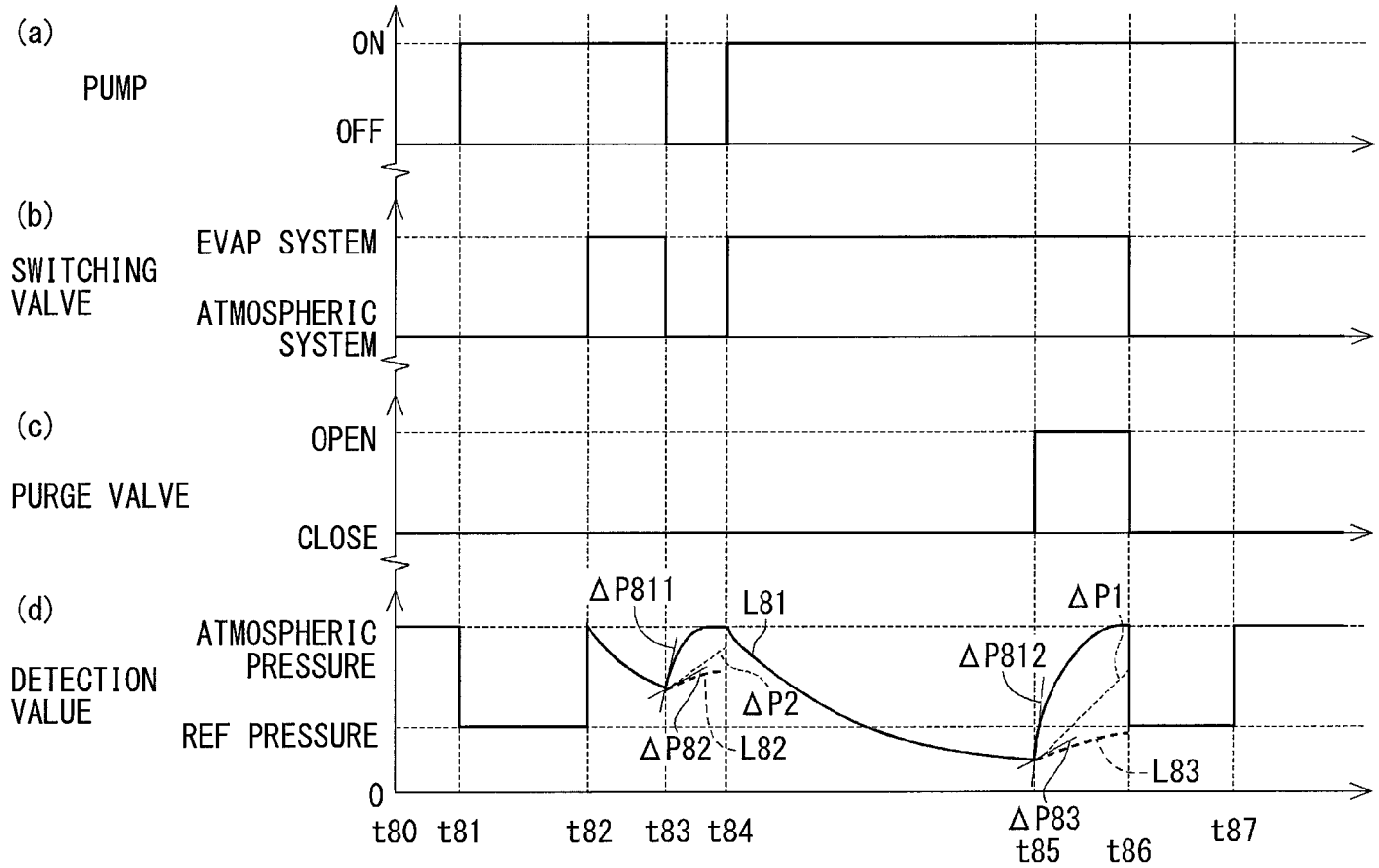
FIG. 17 is a time chart illustrating the operation of the pump, the switching valve and the purge valve together with the detection value of the pressure sensor in the fuel vapor leakage detection method in the eighth embodiment of the present disclosure.

FIG. 16 is a flowchart of a leak check process in the eighth embodiment. FIG. 17 is an operation diagram of various parts in the leak check process of the eighth embodiment, including an operation state of the pump 22, a switching state of the switching valve 30, an opening and closing state of the purge valve 14, and time change of a detection value of the pressure sensor 24.

The leak check process of the eighth embodiment is performed similarly to the process of the leak check from step S200 to step S203 in the second embodiment. More practically, the process in S800 measures the atmospheric pressure (i.e., during a period between time t80 and time t81 in FIG. 17). Then, in S801, the process operates the pump 22, and measures the first reference pressure (i.e., during a period between time t81 and time t82 in FIG. 17). Then, in S802, the process switches the switching valve 30, and depressurizes the evaporation system (i.e., during a period between time t82 and time t83 in FIG. 17). Then, in S803, the process stops the operation of the pump 22, and switches the switching valve 30 (i.e., at time t83).

Then, in S804, it is determined whether a time change of the detection value of the pressure sensor 24 is greater than a predetermined second time change ΔP2. When the air passage 281 is not clogged, the pressure of the atmospheric system quickly recovers. Therefore, a time change ΔP of a pressure of the atmospheric system after stopping the operation of the pump 22 and switching of the switching valve 30 is greater than the predetermined second time change ΔP2. More practically, a time change ΔP811 that is represented as a tangential line of a solid line L81 just after time t83 in FIG. 17 is greater than the second time change ΔP2. On the other hand, when the air passage 281 is clogged, the time change of the pressure in the atmospheric system has a very slow increase or no increase. Therefore, in such case, the time change ΔP of a pressure of the atmospheric system after stopping of the operation of the pump 22 and switching of the switching valve 30 is equal to or smaller than the predetermined second time change ΔP2. More practically, a time change ΔP82 that is represented as a tangential line of a dotted line L82 just after time t83 is equal to or smaller than the second time change ΔP2 in FIG. 17.

The detection value of the pressure sensor 24 during a period between time t83 and time t84 is recorded in the ECU 8, and, when the time change ΔP of the detection value of the pressure sensor 24 just after time t83 is greater than the second time change ΔP2, it is determined that there is no clogging in the atmospheric passage 281, and the process proceeds to S805. When the time change ΔP of the detection value of the pressure sensor 24 just after time t83 is equal to or smaller than the second time change ΔP2, it is determined that there is a clogging in the air passage 281, and the process finishes a leak check.

Then, similarly to S205 of a leak check in the second embodiment, the process starts the operation of the pump 22 in a leak check in S805, and switches the switching valve 30 and depressurizes the evaporation system, and records the detection value of the pressure sensor 24 at time t85 in the ECU 8. Then, similarly to S206 of a leak check in the second embodiment, the process opens the purge valve 14 in S806.

In S807, it is determined whether a time change of the detection value of the pressure sensor 24 is greater than the predetermined first time change API. When the purge passage 131 is not clogged, the pressure of the purge system quickly recovers. Therefore, a time change ΔP of a pressure of the purge system after the opening of the purge valve 14 is greater than the predetermined first time change ΔP1. More practically, a time change ΔP812 that is represented as a tangential line of the solid line L81 just after time t85 in FIG. 17 is greater than the first time change ΔP1. On the other hand, when the purge passage 131 is clogged, the time change of the pressure in the purge system has a very slow increase or no increase. Therefore, in such case, the time change ΔP of a pressure of the purge system after the opening of the purge valve 14 is equal to or smaller than the predetermined first time change ΔP1. More practically, a time change ΔP83 that is represented as a tangential line of a dotted line L83 just after t85 is equal to or smaller than the first time change ΔP1 as shown in FIG. 17.

The detection value of the pressure sensor 24 during a period between time t85 and time t86 is recorded in the ECU 8, and, when the time change ΔP of the detection value of the pressure sensor 24 just after time t85 is greater than the first time change ΔP1, it is determined that there is no clogging in the purge passage 131, and the process proceeds to S808. When the time change ΔP of the detection value of the pressure sensor 24 just after time t85 is equal to or smaller than the first time change ΔP1, it is determined that there is a clogging in the purge passage 131, the process finishes a leak check.

Then, similarly to S208 of a leak check in the second embodiment, the process measures, in a leak check in S808, the second reference value, and compares (i) the second reference value with (ii) the detection value of the pressure sensor 24 at time t85 which is detected in S805. Then, similarly to S209 of a leak check in the second embodiment, the process stops the operation of the pump 22, and finishes a leak check (i.e., at time t87 of FIG. 17).

In the fuel vapor leakage detection method of the eighth embodiment, the process detects the clogging of the purge passage 131 and the clogging of the air passage 281 as a leak check at an engine stop time (i.e., when the engine 9 is stopped). In such manner, the fuel vapor leakage detection method in the eighth embodiment achieves the same effects as the second embodiment.

Further, in the fuel vapor leakage detection method of the eighth embodiment, the clogging of the purge passage 131 and the clogging of the air passage 281 are detected based on a large-small (i.e., magnitude) relationship between a time change ΔP of the detection value of the of the pressure sensor 24 and a predetermined time change (i.e., a threshold value). In such manner, in comparison to the fuel vapor leakage detection method of the first embodiment, a waiting time for waiting for a stabilized pressure in the purge passage 131 and in the air passage 281 is not required any more, and an operation time of the pump is shortened. Therefore, power consumption by the operation of the pressure sensor and the pump can be reduced.

(Other Embodiments)

Although the present disclosure has been fully described in connection with the above embodiment thereof with reference to the accompanying drawings, it is to be noted that various alterations and modifications will become apparent to those skilled in the art.

For example, the following modifications may be implemented.

(a) The pump in the above embodiments sucks air (i.e., provides negative pressure) in the evaporation system and the atmospheric system. However, the pump may pressurize the evaporation and the atmospheric system.

(b) The clogging of the purge passage is determined based on whether the detection value of the pressure sensor at a predetermined time is the same as the atmospheric pressure, in the above-described third to sixth embodiments. Further, in the fourth embodiment, the clogging of the air passage is determined based on whether the detection value of the pressure sensor at a predetermined time is the same as the first reference pressure. Further, in the third, fifth and sixth embodiments, the clogging of the air passage is determined based on whether the detection value of the pressure sensor at a predetermined time is the same as the atmospheric pressure. However, how to determine the clogging of the purge/air passage is not necessarily limited to the above. The clogging of those passages may be determined based on the time change of the detection value of the pressure sensor as disclosed in the fuel vapor leakage detection method in the seventh/eighth embodiment.

(c) In the above-described seventh and eighth embodiments, the time change of the pressure in the purge passage or in the air passage just after the opening of the purge valve or just after the switching of the switching valve is compared with the predetermined time change. However, the time change of the pressure to be compared with the predetermined time change is not only be a time change of the purge/air passage pressure of a just-after-valve-opening/switching time. That is, the time change of the purge/air passage pressure after a predetermined lapse time from the valve-opening/switching may also be compared with the predetermined time change.

Such changes and modifications are to be understood as being within the scope of the present disclosure as defined by the appended claims.

What is claimed is:

1. A fuel vapor leakage detection device, comprising:

a canister connection passage connected to a canister that absorbs a fuel vapor in a fuel tank;

an air passage for allowing fluid communication between the canister connection passage and atmosphere;

a pressure detection passage for allowing fluid communication with the canister connection passage;

a switching valve selectively switching fluid communication of the canister connection passage with one of the pressure detection passage or the air passage;

a bypass passage for bypassing the switching valve that provides fluid communication between the canister connection passage and a pressure detection passage;

a pressure-depressure unit (i) pressurizing or depressurizing the fuel tank and the canister when the switching valve establishes fluid communication between the canister connection passage and the pressure detection passage and (ii) pressurizing or depressurizing the air passage when the switching valve establishes fluid communication between the canister connection passage and the air passage;

a throttle positioned within the bypass passage;

a pressure detector detecting a pressure of the pressure detection passage and outputting a signal according to a detected pressure of the pressure detection passage;

a purge valve fluidly connected to a purge passage, the purge valve opening and closing fluid communication between an intake air passage of an internal combustion engine and the canister;

a valve controller for controlling the switching valve and the purge valve;

a purge passage clog determination unit configured to determine a clog of the purge passage that is in communication with the pressure detection passage based on the pressure of the pressure detection passage which is detected by the pressure detector;

an air passage clog determination unit configured to determine a clog of the air passage that is in communication with the pressure detection passage based on the pressure of the pressure detection passage; and an Electronic Control Unit (ECU) configured to control an operation of each of the pressure-depressure unit, the pressure detector, the valve controller, the purge passage clog detection unit, and the air passage clog detection unit, via an electrical connection with the pressure-depressure unit, the pressure detector, the valve controller, wherein the ECU is configured to determine a clog of the purge passage based on a detection result of the purge passage clog determination unit, determine a clog of the air passage based on a detection result of the air passage clog determination unit, and determine a leakage of the fuel vapor from the fuel tank, from the canister or from the purge passage within a preset time.

2. The fuel vapor leakage detection device of claim 1, wherein the preset time is a time between a start of drive of the pressure-depressure unit and a stop of drive thereof.

3. A fuel vapor leakage detection device of claim 1, wherein the ECU is configured to operate, within the preset time, in order starting from the purge passage clog determination unit, then operate the air passage clog determination unit, and then operate a leak check unit.

4. The fuel vapor leakage detection device of claim 1, wherein the ECU is configured to operate, within the preset time, in order starting from the air passage clog determination unit, then operate the purge passage clog determination unit, and then operate a leak check unit.

5. A fuel vapor leakage detection device of claim 1, wherein the ECU is configured to operate, within the preset time, in order starting from the purge passage clog determination unit, then operate a leak check unit, and then operate the air passage clog determination unit.

6. A fuel vapor leakage detection device of claim 1, wherein the ECU is configured to operate, within the preset time, in order starting from the air passage clog determination unit, then operate a leak check unit, and then operate the purge passage clog determination unit.

7. The fuel vapor leakage detection device of claim 1, wherein at a timing immediately before operating one of the purge passage clog determination unit and the air passage clog determination unit, the ECU is configured to control the pressure of the pressure detection passage to be greater than the reference pressure by pressurizing or to be smaller than the reference pressure by depressurizing, and at a timing immediately before operating the other one of the purge passage clog determination unit and the air passage clog determination unit, the ECU is configured to control the pressure of the pressure detection passage to be equal to or greater than the reference pressure by depressurizing or to be equal to or smaller than the reference pressure by pressurizing.

* * * * *